US005140369A

United States Patent [19]

Haneda et al.

[11] Patent Number: 5,140,369

[45] Date of Patent: Aug. 18, 1992

[54] COLOR IMAGE FORMING APPARATUS HAVING A PROCESS CARTRIDGE CONTAINING A BELT SHAPED IMAGE CARRIER, TONER REPLENISHING MEANS AND DETACHABLE PAPER CARTRIDGE

[75] Inventors: Satoshi Haneda; Shizuo Morita; Masakazu Fukuchi; Shunji Matsuo, all of Hachioji, Japan

[73] Assignee: Konica Corporation, Tokyo, Japan

[21] Appl. No.: 609,918

[22] Filed: Nov. 6, 1990

[30] Foreign Application Priority Data

| | | | |
|---|---|---|---|
| Nov. 15, 1989 | [JP] | Japan | 1-296445 |
| Mar. 5, 1990 | [JP] | Japan | 2-54263 |
| Mar. 14, 1990 | [JP] | Japan | 2-25812 |
| Mar. 20, 1990 | [JP] | Japan | 2-71237 |

[51] Int. Cl.[5] ..... G03G 15/00

[52] U.S. Cl. ..... 355/210; 346/160; 355/200; 355/212; 355/309; 355/326

[58] Field of Search ..... 355/200, 210, 211, 212, 355/260, 309, 326, 327; 346/160

[56] References Cited

U.S. PATENT DOCUMENTS

| | | | |
|---|---|---|---|
| 3,947,114 | 3/1976 | Washio et al. | 355/327 |
| 4,531,823 | 7/1985 | Deguchi et al. | 355/309 X |
| 4,634,264 | 1/1987 | Takahashi | 355/200 |
| 4,754,293 | 6/1988 | Aizawa et al. | 346/160 |
| 4,878,091 | 10/1989 | Moria et al. | 355/326 X |
| 4,924,267 | 5/1990 | Yoshikawa et al. | 355/210 |
| 5,063,411 | 11/1991 | Haneda et al. | 355/212 |
| 5,065,195 | 11/1991 | Haneda et al. | 355/212 |

FOREIGN PATENT DOCUMENTS

| | | |
|---|---|---|
| 60-25850 | 4/1985 | Japan . |
| 60-76766 | 5/1985 | Japan . |
| 60-95456 | 5/1985 | Japan . |
| 60-95458 | 5/1985 | Japan . |
| 1584758 | 8/1985 | Japan . |
| 61-100770 | 5/1986 | Japan . |
| 61-149972 | 7/1986 | Japan . |
| 244058 | 10/1988 | Japan . |
| 244059 | 10/1988 | Japan . |
| 244064 | 10/1988 | Japan . |
| 179168 | 7/1989 | Japan . |

*Primary Examiner*—R. L. Moses
*Assistant Examiner*—J. E. Barlow, Jr.
*Attorney, Agent, or Firm*—Frishauf, Holtz, Goodman & Woodward

[57] ABSTRACT

In a color image forming apparatus has a interchangeable belt-shaped image forming body stretched between horizontally disposed rollers and a plurality of developing means located below the belt-shaped image forming body. A passage for the transfer paper conveyance unit preferably as well as a fixing unit can be opened so that a process unit comprising the above-mentioned belt-shaped image forming body can be attached to and detached from the apparatus in the same direction as the above-mentioned passage for the transfer paper conveyance unit.

Furthermore, the feeding operation for a sheet by-pass or loading and unloading operation for the recording paper cassette can be also carried out in the same direction as the above-mentioned passage of the transfer paper conveyance unit.

9 Claims, 16 Drawing Sheets

COLOR IMAGE FORMING APPARATUS HAVING A PROCESS CARTRIDGE CONTAINING A BELT SHAPED IMAGE CARRIER, TONER REPLENISHING MEANS AND DETACHABLE PAPER CARTRIDGE

BACKGROUND OF THE INVENTION

The present invention relates to a color image forming apparatus by which a color image can be obtained in such a manner that: a toner image is formed on a belt-shaped image forming body by means of electrophotography; and the toner image is transferred onto a transfer sheet.

Numerous electrophotographic methods and apparatus for color image forming have been proposed heretofore. For instance, the following color image forming method has been disclosed in the official gazette of Japanese Patent Application Open to Public Inspection No. 100770/1986: latent images, the number of which corresponds to the number of separated colors of a document image, are formed and developed on a photoreceptor drum which functions as an image carrier. The developed image is transferred onto the surface of a transfer drum every time a latent image is developed so that a multicolor image can be obtained; and after transfer, the multicolor image is transferred onto a recording paper to obtain a color copy. In the color image forming apparatus described above, it is necessary to install not only a photoreceptor drum but also a transfer drum around the photoreceptor drum. Thus the circumferential surface of the transfer drum has to be wide enough to transfer an image sheet. Accordingly, the image forming apparatus is large and the structure is complicated.

Another color image forming method in which electrophotography is utilized, has been disclosed in the official gazette of Japanese Patent Application Open to Public Inspection 149972/1986, which is characterized in that: latent images, the number of which corresponds to the number of separated colors of a document image, are formed and developed on a photoreceptor drum; and the image is transferred onto a transfer sheet every time development is conducted. In this method, it is difficult to register the multicolor images with high accuracy, so that a color copy of high quality is hard to obtain.

Further another color image forming apparatus has been disclosed which is characterized in that: latent images, the number of which corresponds to the number of separated colors of a document image, are formed on a photoreceptor drum; the formed latent images are repeatedly developed by color toners so that color images can be registered on the photoreceptor drum; and the registered color toner images are transferred onto a recording paper in order to obtain a color image. The basic process of this multicolor image forming has been disclosed in the official gazettes of Japanese Patent Application Open to Public Inspection No. 75850/1985, 76766/1985, 95456/1985, 95458/1985, and 158475/1985, which were applied for by the present inventors.

In the color image forming apparatus in which a color image can be obtained by registering multicolor images, a plurality of developing units containing different color toners are provided around the photoreceptor drum, and the photoreceptor drum is usually rotated a plurality of times so that the color toner image on the photoreceptor drum can be developed in order to obtain a color image.

Regarding an image forming body, a belt-shaped image forming body in which a photoconductor is coated or fitted on a flexible belt has been proposed as well as the above-described photoreceptor drum in which a photoconductor is coated or vapor-deposited on the drum surface. A belt-shaped image forming body, which will be called a photoreceptor belt hereinafter, is stretched between rollers including a drive roller, so that the space can be effectively utilized. Accordingly, utilizing a photoreceptor belt is an effective way to make a color image forming apparatus compact. Since the photoreceptor belt can be run along a small radius of curvature, a roller of small diameter can be used for the belt so that a transfer sheet can be separated from the belt at the position where the radius of curvature is small. In this way, the occurrence of separation failure of a transfer sheet can be prevented.

Regarding an image forming apparatus in which a process cartridge is utilized, which apparatus has been disclosed in the official gazettes of Japanese Patent Application Open to Public Inspection Nos. 244059/1988 and 244064/1988, the divided structure of transfer paper conveyance passage to remove a jammed transfer sheet has been proposed. In this case, however, the wiring of the fixing unit must be composed in such a manner that it can be divided, and the fixing unit must be composed so that it can be separated from the main body of the apparatus. Accordingly, this type of image forming apparatus is very disadvantageous to manufacture and operate.

In the case of this type of photoreceptor belt, the belt is horizontally stretched for the purpose of reducing the height of the apparatus, so that image forming means such as developing means and the like are provided below the photoreceptor belt.

The above-described photoreceptor bet and a group of developing units are formed into a unit and installed in the main body of the apparatus, ant further the paper feed cassette which contains recording papers is horizontally provided in the lower space. Therefore, in the case of image forming apparatus in which the photoreceptor belt is used, an apparatus has a paper feeding passage on the side of the image forming apparatus, which passage is vertically formed in such a manner that the recording paper is conveyed upward from the paper cassette located under the photoreceptor belt. Accordingly, in order to open the paper feeding passage, it is not sufficient to take out the above-described units. Since problems arise when removing jammed paper.

On the other hand, the lid of the above-described cassette chamber is provided on the side wall of the apparatus main body opposite to the side wall along which the above-described paper feeding passage and paper feeding means are provided, so that the paper feeding cassette can be inserted in the same direction as the paper feeding.

Consequently, there are caused the following disadvantageous in the above-described color image forming apparatus: other than the lid of the cassette chamber, a lid to remove a jammed paper from the paper feed passage needs to be provided on the apparatus main body side wall along which the above-described paper passage is provided; a large opening through which a cartridge is attached to and detached from the apparatus, in the case of image forming apparatus in which the photoreceptor belt and the developing units are integrally provided to form a cassette; and in the case of an image forming apparatus having the function of sheet by-pass, an opening to feed a paper manually needs to be provided. As a result, the structure of the apparatus becomes complicated and the production cost is increased. Further the operation and maintenance must be conducted over two surfaces, so that the working efficiency is decreased and furthermore a wide floor space is needed to operate and maintain the apparatus.

Recently, a color image forming apparatus in which a jammed paper can be easily removed and the cassette can be easily replaced have been disclosed in the official gazettes of Japanese Patent Application Open to Public Inspection Nos. 244058/1988, 244059/1988, 244064/1988 and 179168/1989. In this type of color image forming apparatus, the operation and maintenance can be conducted in the same direction. However, a color image forming apparatus which meets the requirements of users and service men such as replacing consumables quickly, replacing units easily and maintaining the apparatus efficiently, has not been developed heretofore.

Further, in the case of an image forming apparatus in which the paper feed cassette is inserted from the opposite side of the paper feed passage and the paper feed means, two side walls of the apparatus which are opposed to each other need to be opened in case a transfer paper jam has occurred, so that a wide space is needed to install the apparatus.

In order to overcome the disadvantage described above, an improved image forming apparatus has been proposed which is characterized in that: the cassette insertion opening is provided on the same main body side wall is the paper feeding passage; and all operation and maintenance work such as the insertion of the paper feeding cassette, the operation of each unit, the removal of a jammed paper and the maintenance work can be conducted on the front face of the apparatus.

In this type of prior art image forming apparatus, the fitted recording paper cassette protrudes from the apparatus main body, and the recording paper cassette can be easily attached to and detached from the apparatus main body by holding the protruding portion of the cassette.

However, there is a demand for compact image forming apparatus, so that the protruding paper cassette is not preferable because it takes a wide floor space.

SUMMARY OF THE INVENTION

The object of the present invention s to provide a color image forming apparatus which is characterized in that: a lid is provided to the side portion of the apparatus so that it can be opened and closed in order to open a paper feeding passage; and further a belt-shaped image forming body unit can be attached to and detached from the apparatus main body in the horizontal direction by utilizing the thus opened lid.

Another object of the present invention is to provide a color image forming apparatus in which all operation and work can be carried out on one side face of the apparatus.

Further another object of the present invention is to provide a color image forming apparatus which is characterized in that: the fitted recording paper cassette is not protruded from the color image forming apparatus main body; and the recording paper cassette can be easily attached to and detached from the apparatus.

The above-described object can be accomplished by a color image forming apparatus having a belt-shaped image forming body stretched between horizontally located rollers and having a plurality of developing means located below the belt-shaped image forming body, and which color image forming apparatus is characterized in that: the transfer paper conveyance unit and preferably the fixing portion can be opened; and the process unit provided with the above-described belt-shaped image forming body can be attached to and detached from the apparatus main body in the same direction as the above-described transfer paper conveyance unit.

The above-described another object can be accomplished by a color image forming apparatus comprising: a process cartridge to which at least an exchangeable belt-shaped photoreceptor and a plurality of developing units located around the photoreceptor are integrally provided; the first paper feed means composed of a sheet by-pass guide; the second paper feed means composed of at least one detachable transfer paper holding means; and a transfer sheet conveyance passage, at least one side face of which can be opened, wherein the replacement of the above-described process cartridge, feed operation at the sheet by-pass and detaching operation of the transfer paper holding means can be conducted in the same direction of the apparatus.

Further another object of the present invention is to provide a color image forming apparatus comprising: a process cartridge provided with at least a detachable belt-shaped photoreceptor and a plurality of developing units, which are installed in the lower half of the color image forming apparatus having such a structure that the apparatus is composed of the upper half and lower half and the upper half can be opened from the lower half; a transfer sheet conveyance means, the transfer sheet conveyance passage of which is an opening surface and at least one side face can be opened; the first paper feeding means composed of a sheet by-pass guide; and the second paper feeding means composed of at least one detachable transfer paper holding means; wherein the replacement of the process cartridge, operation at the sheet by-pass and the attaching and detaching operation of the transfer paper holding means can be conducted from the above-described side face.

Further another object can be accomplished by a color image forming apparatus which is characterized in that: and a handle provided in the recording paper cassette removal direction is in the relation of engagement with the image recording apparatus, wherein the paper feeding means can be released and pulled out in the direction of the handle by pulling the above-described paper feeding cassette with the above-described handle.

BRIEF DESCRIPTION OF THE DRAWINGS

FIG. 1(*b*) is a sectional view which shows the main portion of the transfer sheet conveyance passage.

DESCRIPTION OF THE PREFERRED EMBODIMENTS

Figure 1A:
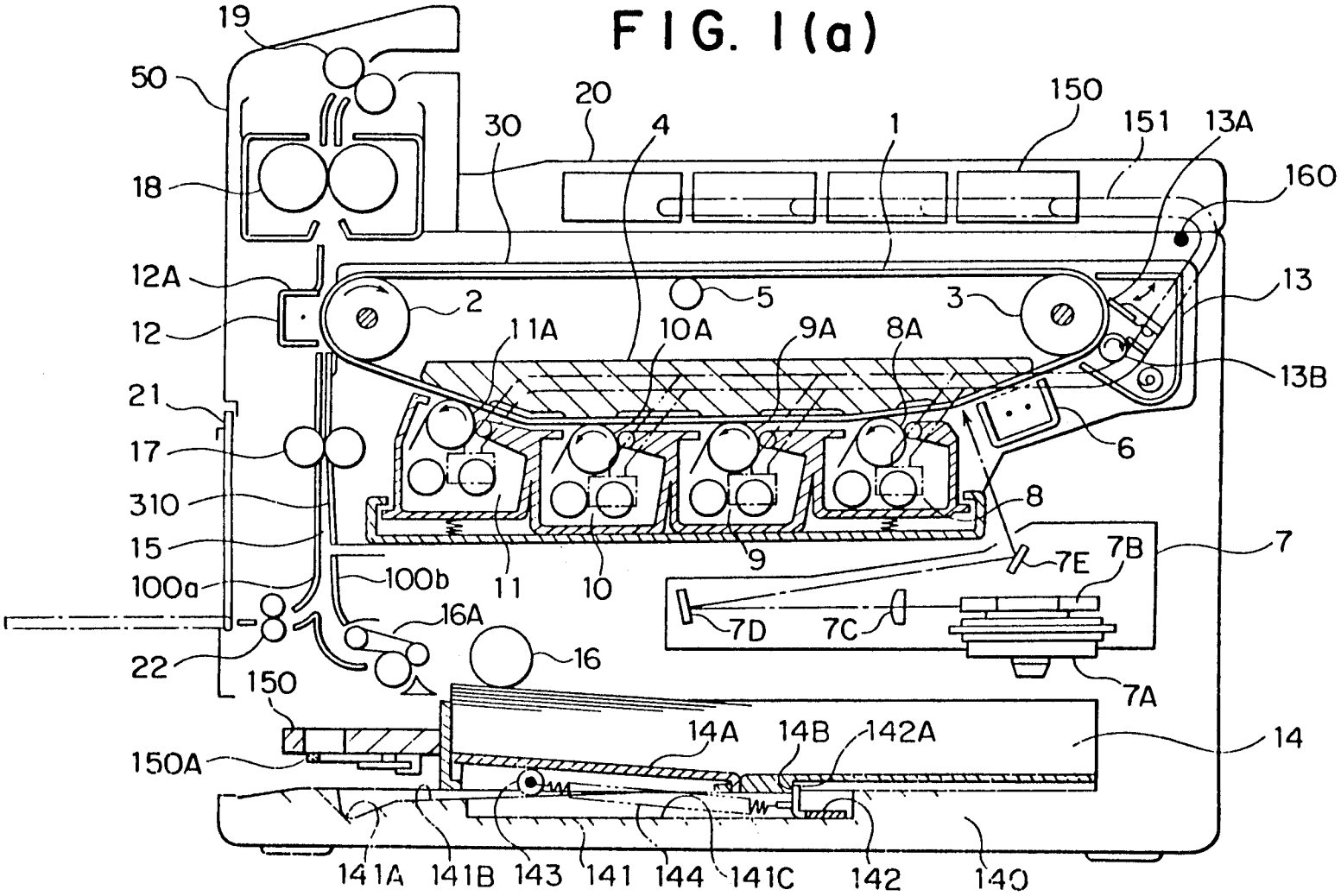
FIG. 1(*a*) and FIG. 7 are sectional views of a color image forming apparatus of the present invention
Figure 1B:
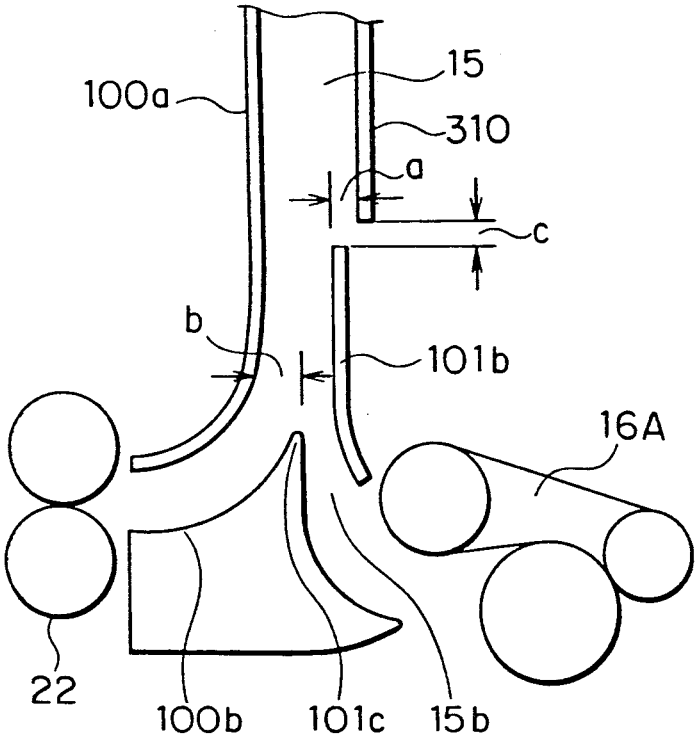
Figure 7:
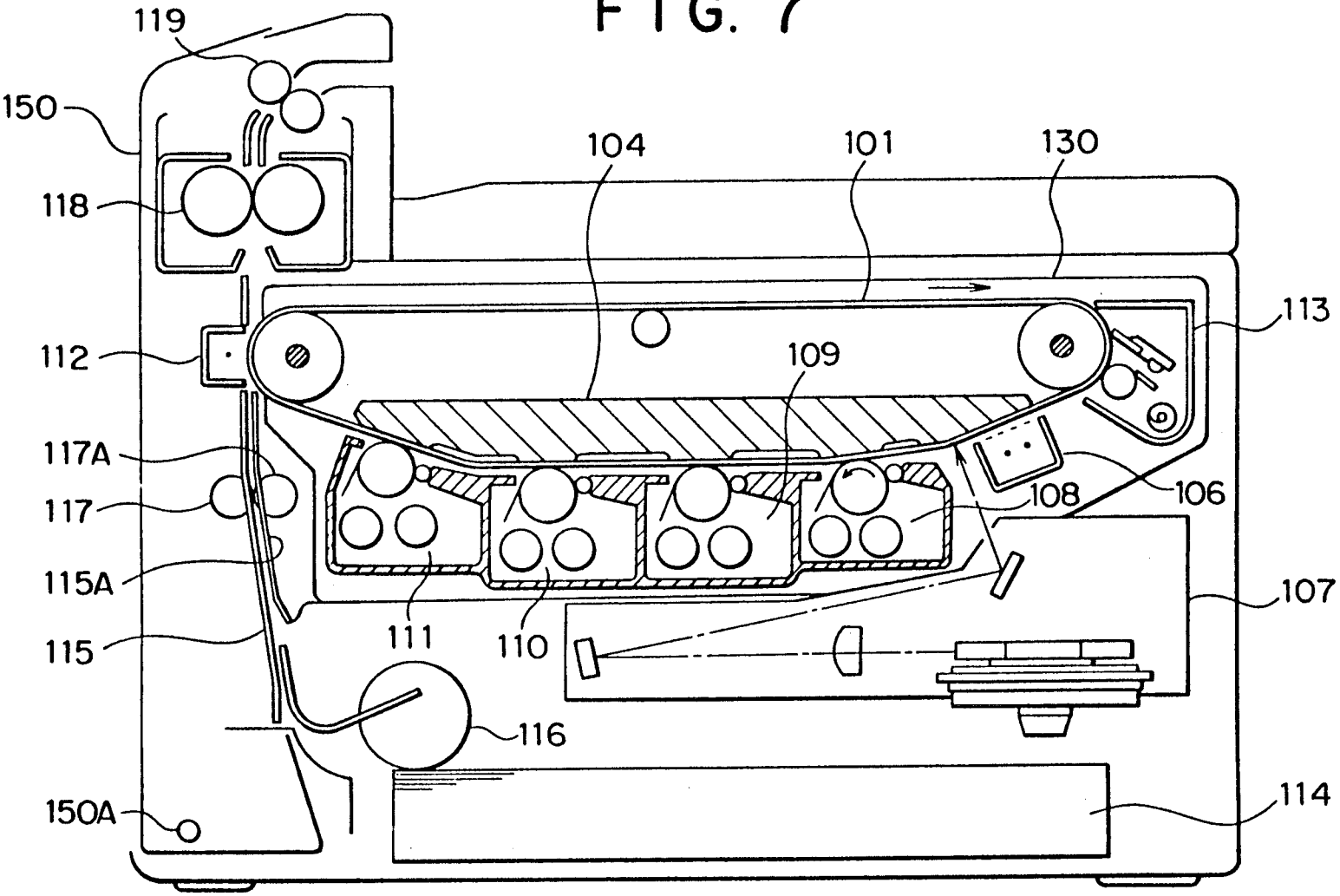

An example of the color image forming apparatus of the present invention is shown in FIG. 1(*a*) to FIG. 7.

In FIG. 1(*a*), the numeral 1 is a flexible photoreceptor belt, which is a belt-shaped image forming body. The photoreceptor belt 1 is stretched between the rollers 2, 3 and rotated clockwise by the drive force of the roller 2.

The numeral 4 is a guide member which is located inside the above-described photoreceptor belt 1 in such a manner that it touches the belt internally, wherein the guide member is fixed to the apparatus main body. Tension is given to the above-described photoreceptor belt by the action of the tension roller 5 so that the inner circumferential surface of the belt slidably comes into contact with the guide member 4 which has a constant curvature of radius. Cut-out portions are formed in the regions of the guide member 4 which are not necessary for image forming, in order to reduce frictional resistance caused by slidable contact between the guide member 4 and the photoreceptor belt 1. As a matter of course, these cut-out portions can be omitted when the frictional resistance due to sliding is low. In order to reduce the friction between the photoreceptor belt 1 and the guide member 4, it is preferable to coat materials of low friction on the surface of either the photoreceptor belt 1 or the guide member 4, for instance Teflon coating may be applied to the surface, otherwise either the photoreceptor belt 1 or the guide member 4 may be made from material of low friction.

Accordingly, the photoreceptor provided on the outer surface of the above-described photoreceptor belt, is always kept at a constant position with regard to the surface of the above-described guide member 4 during conveyance, so that it is possible to provide a stabilized image forming surface on the outer surface of the photoreceptor belt.

Since developing units and a cleaning unit are installed below the photoreceptor belt, splashing of spilling of developer can be prevented.

The numeral 6 is a scorotron charger. The numeral 7 is a laser writing unit, which is an image exposure means. The numerals 8 to 11 are a plurality of developing means in which the developers of specific colors are contained. The above-described image forming means are located at the positions opposed to the above-described guide member 4 of the photoreceptor belt 1. In order to keep a constant gap between the photoreceptor belt surface and the image forming members so that the photoreceptor belt can be moved freely, a gap keeping means is provided to the above-described guide member 4 outside the the photoreceptor belt.

An optical system in which a light emitting unit and photoconductor are integrally provided, may be used as the above-described laser writing unit 7 other than the one illustrated in the drawing.

The above-described developing means 8, 9, 10, 11 contain developers of yellow, magenta, cyan and black, for instance, and they are provided with the developing sleeves 8A, 9A, 10A, 11A which are located in such a manner that the gaps between the surfaces of the developing sleeves are kept to be a predetermined value so that the latent image on the photoreceptor belt can be developed into a visible image by the non-contact developing method. The non-contact developing method has the advantage that the developing sleeves do not obstruct the movement of the photoreceptor belt.

The numeral 12 is a transfer unit. The numeral 12A is a discharge bar. The numeral 13 is a cleaning unit. The blade 13A of the cleaning unit 13 and the toner conveyance roller 13B are separated from the surface of the photoreceptor belt 1 during image forming, and they come into contact with the surface of the belt with pressure only when cleaning is conducted after image transfer.

The color image forming in the above-described color image forming apparatus is conducted according to the following process.

Figure 2:
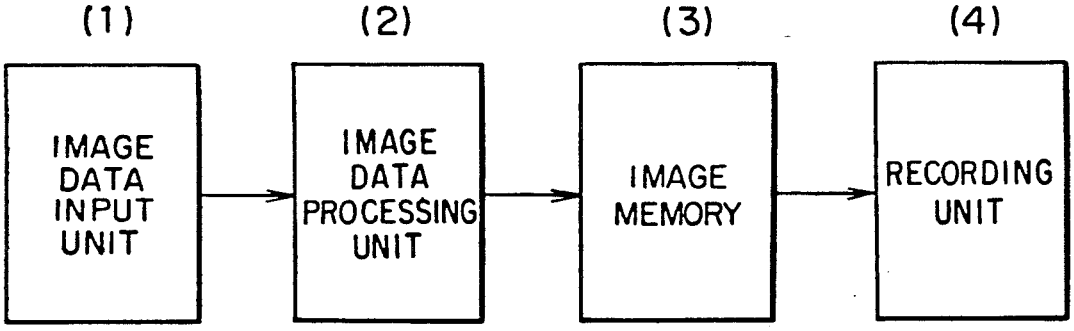
FIG. 2 is a block diagram which shows an image forming system of the present invention.

In this example, multicolor image forming is conducted in accordance with the image forming system illustrated in FIG. 2. Specifically, the data obtained by the image data input unit is sent to the image data processing unit which is represented by the numeral (2) in FIG. 2, wherein the image data input unit is represented by the numeral (1) in FIG. 2, and wherein the image pick-up element scans an original image is the image data input unit (1). The data is processed in the image data processing unit (2) so that the image data can be made. The processed data is once stored in an image memory which is represented by the numeral (3) in FIG. 2. When recording is conducted, the stored image data is taken out of the memory and outputted to the color image forming unit illustrated in FIG. 1(*a*), for instance, which is a recording unit (4) in FIG. 2.

When a color signal outputted from a image reading apparatus different from the above described printer, is inputted into the above-described laser writing unit 7, the following operations are conducted in the laser writing unit 7. The laser beams generated by semiconductors not illustrated in the drawing, are made incident upon the polygonal mirror 7B which is rotated by the drive motor 7A so that the rotary scanning can be conducted. After that, the laser beams pass through the f$\theta$ lens 7C and the optical path is bent by the mirrors 7D and 7E. Then the laser beams are made incident upon the circumferential surface of the photoreceptor belt 1 upon which electrical charge is previously impressed by the charger 6, which is a charging means, so that a bright line can be formed.

On the other hand, when scanning is started, the laser beams are detected by an index sensor and beam modulation is started by the first color signal. The modulated beams scan the circumferential surface of the above-described photoreceptor belt 1. Accordingly, the latent image corresponding to the first color is formed on the circumferential surface of the photoreceptor belt 1 by the primary scanning conducted by the laser beams and by the subsidiary scanning conducted by the movement of the photoreceptor belt 1. This latent image is developed by the developing means 8 loaded with yellow (Y)

toner, wherein the development is carried out in the way of non-contact reversal development so that the toner image can be formed on the belt surface. The obtained toner image adheres to the belt surface and passes under the cleaning unit 13, which is separated from the circumferential surface of the photoreceptor belt 1. Then, the process advances to the next copy cycle.

Namely, the above-described photoreceptor belt 1 is charged again by the above-described charger 6. Then, the second color signal is inputted into the above-described writing unit 7 and the image data is written in on the belt surface so that the latent image can be formed in the same was the first color signal. The latent image is developed by the developing means 9 loaded with the toner of the second color magenta (M), wherein the development is carried out by the method of non-contact reversal development.

This magenta (M) toner image is formed in the presence of the above-described yellow (Y) tone image which has been already formed.

The numeral 10 is a developing means in which cyan (C) toner is contained, and a cyan (C) toner image is formed on the drum surface by the developing unit 10 according to the control signal generated in the signal processing unit.

Further the numeral 11 is a developing means in which black toner is contained, and a black toner image is registered on the drum surface in the same way as described above. D.C. bias and further A.C. bias are impressed upon the leeves of these developing means 8, 9, 10, 11 so that jumping development can be conducted by one-component or two-component developer which is the visual image means. In other words, development is conducted on the surface of the photoreceptor drum, the base of which is connected to the ground, by the method of non-contact development.

The color toner image formed on the circumferential surface of the photoreceptor belt 1 in the way described above, is transferred onto the transfer sheet which has been sent from the paper feed cassette 14 in the transfer unit through the paper guide 15.

Specifically, the uppermost transfer sheet in the paper cassette 14 is conveyed by the rotation of the paper feed roller 16 and fed to the transfer unit 12 by the timing roller 17 synchronously with the image formation on the photoreceptor belt 1.

After an image was transferred, the transfer sheet is discharged, so that the image on the sheet is not affected by toner splash. The transfer sheet is positively separated from the photoreceptor belt 1 at the position there the photoreceptor belt 1 is sharply bent by the above-described roller 2. Then, the separated transfer sheet is conveyed upward and the image on the sheet is fixed by the fixing roller 18 and delivered onto the tray 20 through the delivery roller 19.

After the image on the photoreceptor belt 1 was transferred, the photoreceptor belt 1 is continuously rotated and the residual toner is removed from surface of the photoreceptor belt 1 by the cleaning unit 13 which is composed of the blade 13A opposed to the roller 3 and composed of the toner conveyance roller 13B coming into contact with the photoreceptor belt 1 with pressure. After the residual toner has been removed, the above-described blade 13A is separated from the surface of the photoreceptor belt 1. A little after that the toner conveyance roller 13B is also separated from the belt surface, and then the new process is started.

The paper feeding unit and fixing unit are composed in such a manner that they can be opened and closed at any time, so that the removal of a jammed sheet can be easily conducted and the maintenance work can be made simple.

Figure 6:
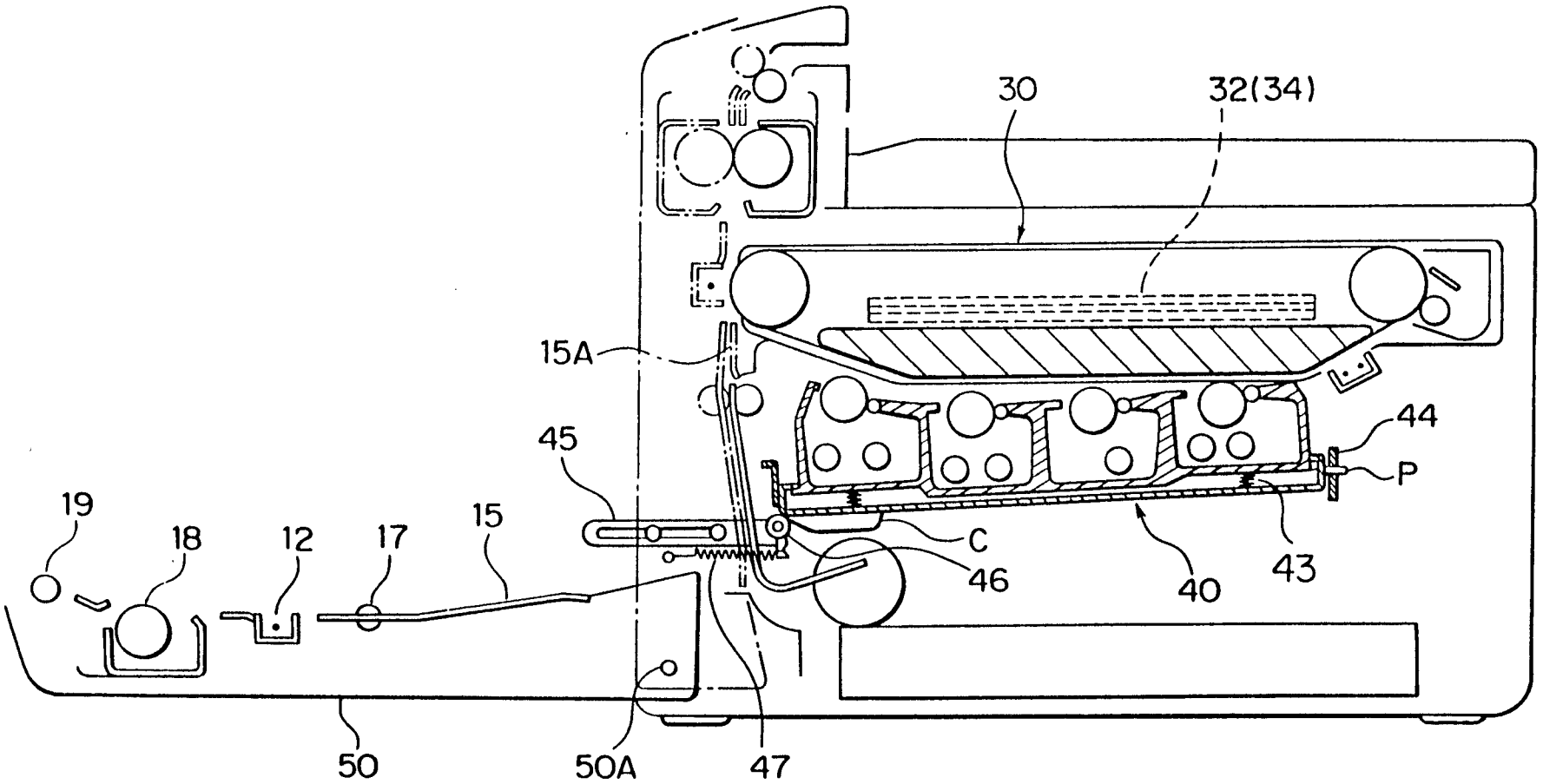
FIG. 6 is a schematic illustration which shows each developing unit installed in the apparatus.

The paper feed guide 15 the timing roller 17, the fixing roller 18 and the delivery roller 19, and the transfer unit 12 are supported by the side cover 50 which can be opened counterclockwise around the rotated shaft 50A of the apparatus main body by the angle of 90°. As illustrated in FIG. 6, when the side cover 50 is opened, the above-described members can be moved from the position indicated by a chained line to the position indicated by a solid line so that each member can be withdrawn and the paper feed and conveyance unit can be completely opened.

Figure 3:
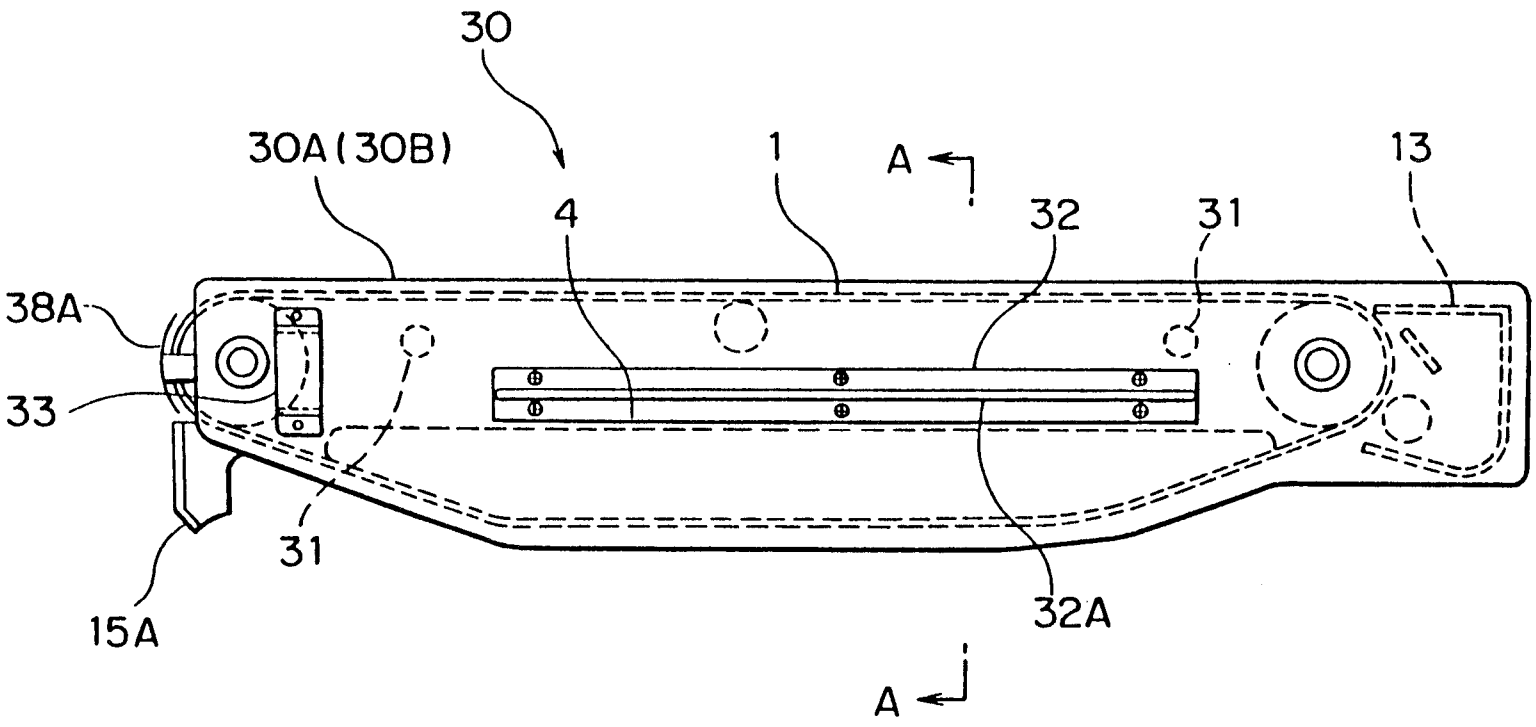
FIG. 3 is a front view of the process unit provided in the above-described apparatus.

On the other hand, as illustrated in FIG. 3 the image forming means comprising the photoreceptor belt 1, the guide member 4 and the cleaning member 13 are installed in the process unit 30 which is composed of the front base plate 30A and the rear base plate 30B, so that the above-described image forming means can be attached to and detached from the apparatus main body together with the process unit. The process unit is formed so flat that the process unit can be easily attached to and detached from the apparatus main body in the direction of the paper feed unit.

The process unit 30 is formed such that the front base 30A and the rear base 30B are integrally connected by the guide member 4 and two stays 31, and the above-described image forming means are held between the front and rear bases.

The rail members 32 composed of C-shaped rails 32A are provided to the outer side surfaces of the front and rear bases 30A, 30B of the above-described process unit 30. When the above-described side cover 50 is opened, the process unit 30 is slid into the apparatus main body by pushing the handle 33 so that the process unit 30 can be installed in the apparatus.

Figure 4:
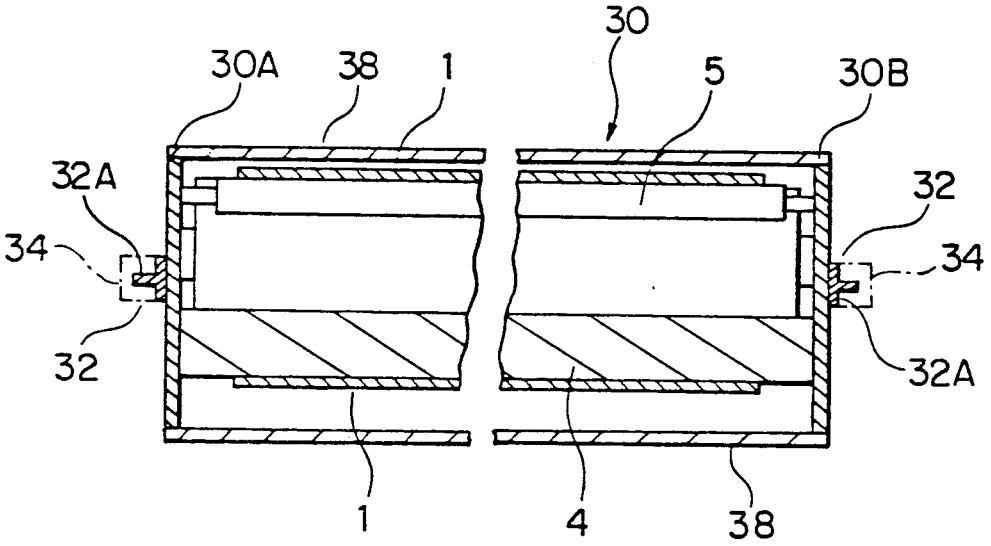
FIG. 4 is a sectional view of the process unit of the above-described apparatus.

FIG. 4 is a sectional view of the above-described process unit 30 taken on line A—A in FIG. 4. The groove portion 34 (illustrated by a chained line) having a U-shaped guide groove which engages with the above-described rail 32A of the rail member 32, is provided inside the apparatus main body. When the above-described rail member 32 is engaged with the groove member 34, the process unit 30 is fitted in the apparatus main body and fixed to the apparatus main body by an engagement member (not illustrated in the drawing). This process unit is covered by the protective cover 38 except the charging, exposing, image forming and transferring units necessary for image forming. Further, it is preferable that the protective cover 38A which can be opened and closed synchronously with the paper feed unit, is integrally provided to the transfer unit.

The paper feed guide piece 15A forming the paper feed guide 15 is supported by the process unit 30 and attached to and detached from the apparatus together with the process unit 30.

Figure 5:
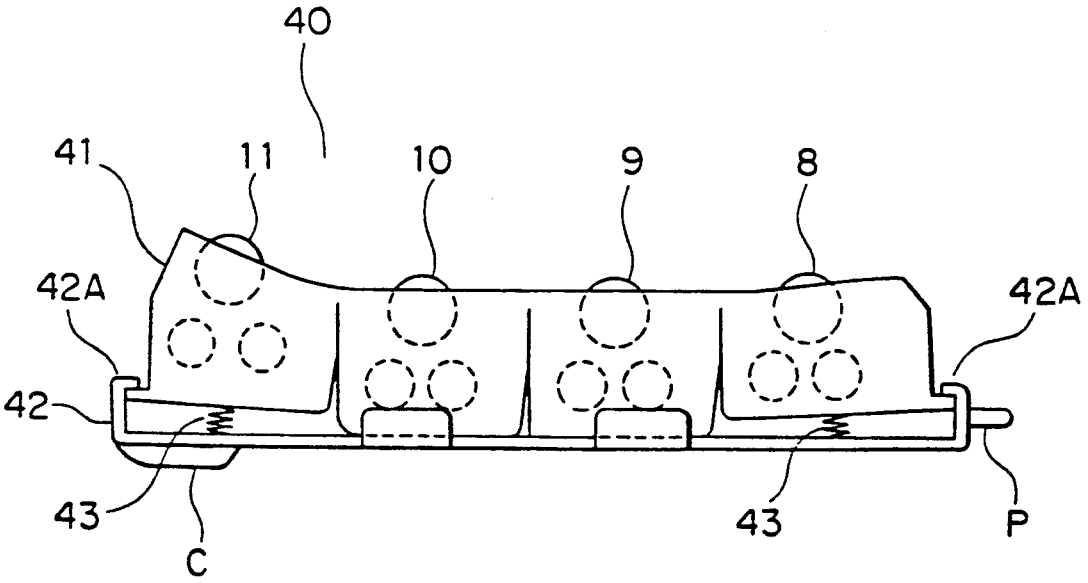
FIG. 5 is a front view of the developing unit of the image forming apparatus.

As illustrated in FIG. 5, the developing means are incorporated in the developing tank 41 which are divided with each other, wherein the partitions of the developing tank 41 is made from flexible material, and the developing tank is supported by the support member 42 so that the developing unit 40 can be attached to and detached from the apparatus main body. Each developing unit may be independently composed of developing means.

The above-described developing tank 41 is composed in such a manner that: a plurality of compression springs 43 is provided between the bottom surface corresponding to the developing means 8 and 11 of the developing tank 41 and the above-described support 42, wherein the compression springs are aligned in the front and rear direction; and the developing tank 41 is engaged with the claw member 42A so that the radius of curvature of the curved surface formed by the developing sleeve surfaces can be smaller than that of the photoreceptor belt 1 formed by the above-described guide member 4.

The above-described developing unit 40 is provided with a pair of engagement pin P which are located on the right side of the support 42 and provided with a pair of cams C which are located at the left edge portion of the support 42, wherein an adequate distance is kept between engagement pins P and cams C respectively.

The developing unit 40 is installed in the apparatus main body previously to the installation of the process unit 30 in such a manner that engagement pin P is engaged with the hole of the guide plate 44 and cam C is set on the roller 46 provided on the pressure plate 45, wherein the roller 46 is opposite to cam C.

Then the process unit 30 is installed in the apparatus main body as illustrated in FIG. 6, and the above-described side cover 50 is rotated clockwise so that it can be closed. At this time, the above-described pressure plate 5 is moved in the right direction since it is pushed by the inner wall of the side cover 50. As a result, the above-described roller 46 on the pressure plate 45 pushes cam C upward, so that the developing unit 40 is moved toward the process unit 30.

Accordingly, the developing unit 40 is pushed upward by the action of the compression spring 43 and each developing sleeve is pushed against the photoreceptor belt so that a predetermined developing gap can be formed.

When the side cover 50 is opened, the above-described pressure plate 45 which has been pushed by the side cover 50, is released, and the pressure plate 45 is returned to the left by the action of the spring 47. As a result, the developing unit 40 is withdrawn by its own weight. Then the process unit 30 is removed from the apparatus main body.

Consequently, each developing means is separated from the photoreceptor belt 1 and the process unit 30 can be taken out of the apparatus main body without interfering with the developing unit 40.

FIG. 7 illustrates a color image forming apparatus in which the process unit and the developing unit are integrally formed so that they can be simultaneously attached to and detached from the apparatus main body. It is to be understood that the present invention can be applied to this type of apparatus.

When the side cover 150 is opened, the transfer paper conveyance unit can be opened and even a large-sized process unit 130 containing developing means can be attached to and detached from the apparatus main body through the opening.

In this case, the charger 106 can be built in the process unit 130 and both of the guide piece 115A provided to the upper portion of the guide 115 and the timing roller 117A are supported by the process unit 130.

FIG. 1(*b*) is an enlarged view of the paper feed and conveyance passage of the color image forming apparatus illustrated in FIG. 1(*a*). When a transfer paper or a special paper for use in an overhead projector is fed from the sheet by-pass guide 21, the paper passes between the conveyance guide (*a*) 100*a* and the conveyance guide (*b*) 100*b*, and further passes through the confluence 101*c* of two passages. Then the paper goes upward 101*d* and passes through the paper feeding passage 15 which is formed by the cartridge side plate 310 and the conveyable guide (*a*) 100*a*, wherein the cartridge side plate 310 is one of the side plates of the cartridge 30 which is inserted into the apparatus main body making a slight gap "a" between the side plate and the upper normal line of the conveyance guide, which gap "a"≧0, preferably "a" is 0.2 to 3 mm. In the way described above, the transfer paper or the sheet for use in overhead projector is conveyed toward the transfer unit 12 without being caught by the edge portion of each guide or the side plate bottom portion 310*a* of the cartridge.

In the same way as described above, the transfer paper sent from the paper feed cassette 14 passes through the confluence 101*c*, and then it passes through gap "b" which is formed between the conveyance guide (*a*) 100*a* opposed to the conveyance guide and the upper normal line, wherein gap "b"≧0, preferably gap "b" is 0.2 to 3 mm. In this way explained above, the transfer paper is conveyed to the above-described paper feed passage 15 without being caught by the guide edge. In both cases, the transfer paper is conveyed through the paper feed passage 15 which is formed in such a manner that: one wall of the passage is the conveyance guide (*a*) 100*a* and the other wall is the side surface of the cartridge body.

Figure 8:
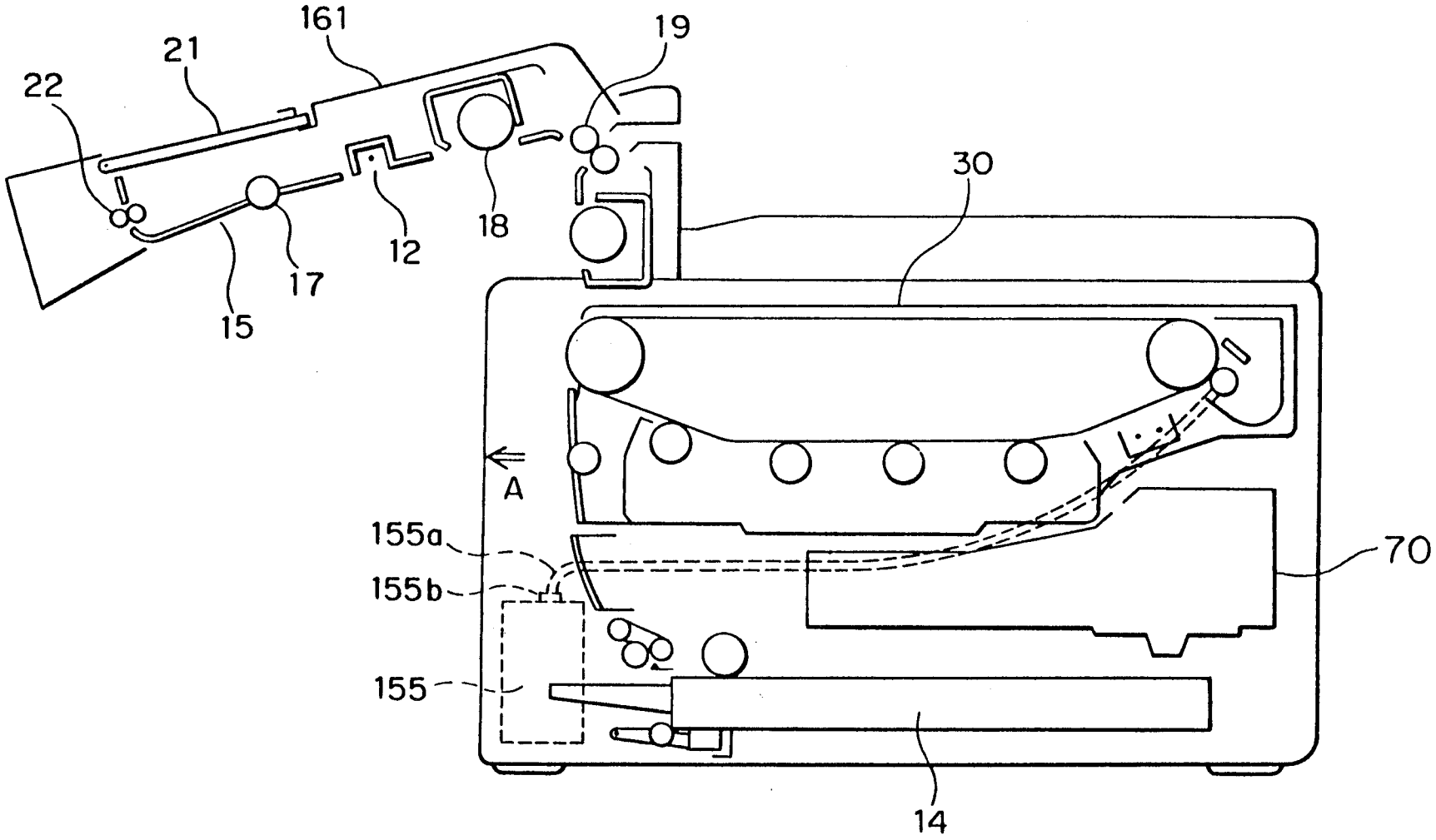
FIG. 8 to FIG. 10 are schematic illustration which show the composition of the main body of the above-described apparatus.

Further gap "c" is made between the above-described conveyance guide 101*b* and the bottom surface 310*b* of the cartridge 30, wherein gap "c"≧0.2, preferably "c" is 0.5 to 2 mm. As illustrated in FIG. 8, when the side cover 161 is opened, the cartridge 30 is attached to and detached from the apparatus main body in the direction of arrow mark A without being caught or blocked by the paper conveyance guide and the like, wherein the cartridge guide provided to the apparatus main body 130 and the cartridge guide provided to the cartridge, both of them are not illustrated in the drawing, are slidably engaged. In this case, the cartridge 30 s inserted first of all, wherein the cartridge guide 130 provided to the apparatus main body is used as the reference to insert the cartridge. Furthermore the cartridge guide is engaged with the frame 70 of the writing system provided to the production of the cartridge guide 130 so that the positional relation between the cartridge 30 and the writing unit 7 can be set with high accuracy by engaging the engagement hole, not illustrated in the drawing, provided to the writing system frame 70 with the protruded member 130*a* provided to the cartridge 30. When the cartridge 30 is connected with the writing unit 7, not only the hole and the pin but also the known lock mechanism of a lever and hook is also used. Accordingly, when the cartridge 30 is inserted into the apparatus, the cartridge 30 is accurately connected with the optical writing unit 7. Although the writing unit 7 is provided in such a manner that it can be easily replaced, the distance from the laser writing unit 7, which is stably installed at a constant position, to the writing position on a photoreceptor belt, can be kept constant while the accuracy required in the case of digital register dot forming is maintained.

The above-described photoreceptor belt 1 and each developing means are integrally provided to the cartridge 30 including the charger 6, the cleaning unit 13, the pair to the paper feed passage 15 and the pair to the timing roller 17 and they are attached to and detached from the apparatus main body by the cartridge guide 130.

When the above-described cartridge 30 is provided to the apparatus main body, the toner conveyance pipe 151 of the toner hopper 150 reciprocal to each developing means is automatically connected with each developing means so that the toner can be supplied.

The above-described apparatus is provided with the paper feed means to feed a transfer paper to the above-described paper feed passage 15, which paper feed means comprises the first paper feed means of sheet by-pass in which the transfer paper is fed from the guide plate 21 located on the side of the apparatus main body, and the second paper feed means in which the transfer paper is automatically fed from the above-described paper feed cassette 14.

The structure of the apparatus main body is as follows. As illustrated in FIG. 1(*a*), A side cover which can be opened and closed is provided to the left side of the main body. The above-described paper feed passage 15 can be freely opened by opening the side cover, and the above described cartridge 30 and further the paper feed cassette 14 can be horizontally attached to and detached from the apparatus through the opening.

FIG. 8 illustrates the first example in which the side cover 161 is provided which can be opened, wherein the axial center of the delivery roller 19 is used as a fulcrum. The side cover 161 holds the pairs to the transfer unit 12, the paper feed passage 15, the timing roller 17 and the fixing roller 18, and further holds the sheet by-pass guide plate 21 and the sheet by-pass guide roller 22, wherein the side cover 161 is opened by the angle of about 90°.

As described above, the cartridge 30 and the paper feed cassette 14 is slid along the guide member, which is the cartridge guide 130, so that it can be attached to and detached from the apparatus without interfering with the paper conveyance member.

After the cartridge 30 is removed from the apparatus main body, in order to maintain the writing unit 7, it is possible to remove the writing unit 7 in the direction of arrow mark A in the drawing from the laser writing unit stand 75 which is integrally provided to the apparatus main body.

Figure 9:
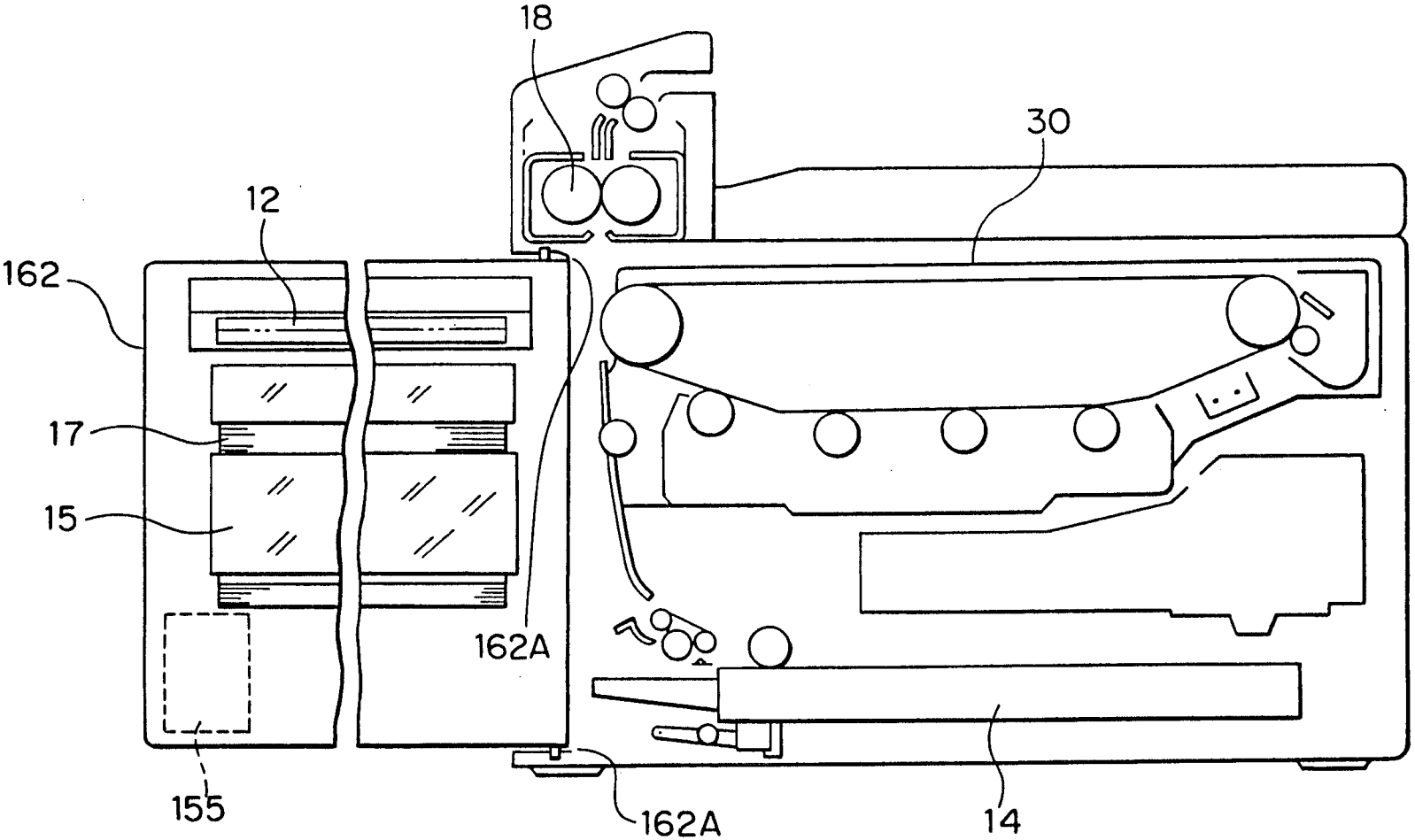

FIG. 9 illustrates the second example in which the side cover 162 can be horizontally opened, wherein the upper and lower supporting shafts 162A are used as a fulcrum. Units and members such as the transfer unit 12 are held by the side cover 162 in the same way as the above-described side cover 161.

As illustrated in FIG. 9, it is possible to integrally provide a conveyance guide to the cartridge 30 which can be attached to and detached from the apparatus main body.

The above-described side cover 162 can be extended upward to the portion in which the fixing roller 18 can be held. Accordingly, when the side cover was composed in this way, the pressed surface of the fixing roller 18 can be released simultaneously with the opening motion of the the side cover 162.

Figure 10:
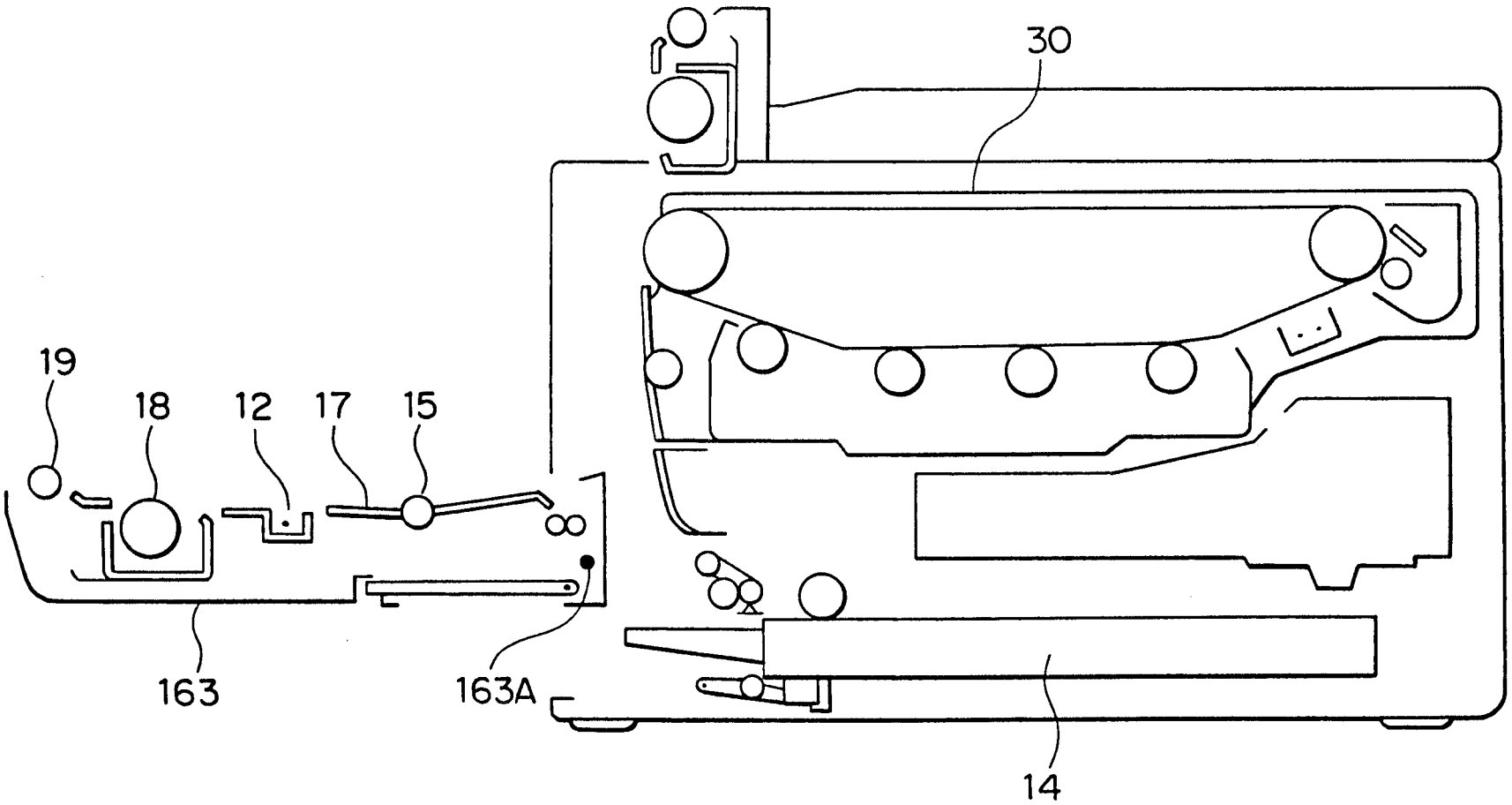

Further FIG. 10 illustrates the third example in which the side cover 163 is opened counterclockwise, wherein the shaft 163A located in the lower portion of the main body is used as a fulcrum. In this case, the above-described side cover 163 covers the area except the opening located around the lower portion of the main portion through which the paper feed cassette is inserted.

As illustrated in FIG. 8 and FIG. 9, the used toner cartridge 155 to collect the used toner conveyed from the cleaning unit 13 so that a detachable used toner collecting unit can be formed. The used toner cartridge 155 is provided as follows. In the apparatus of FIG. 8: the cartridge is located on the left side on the viewer's side. In the apparatus of FIG. 9: the cartridge is located at the left edge or the right edge (not illustrated in the drawing) of the side cover which can be opened and closed.

Figure 11A:
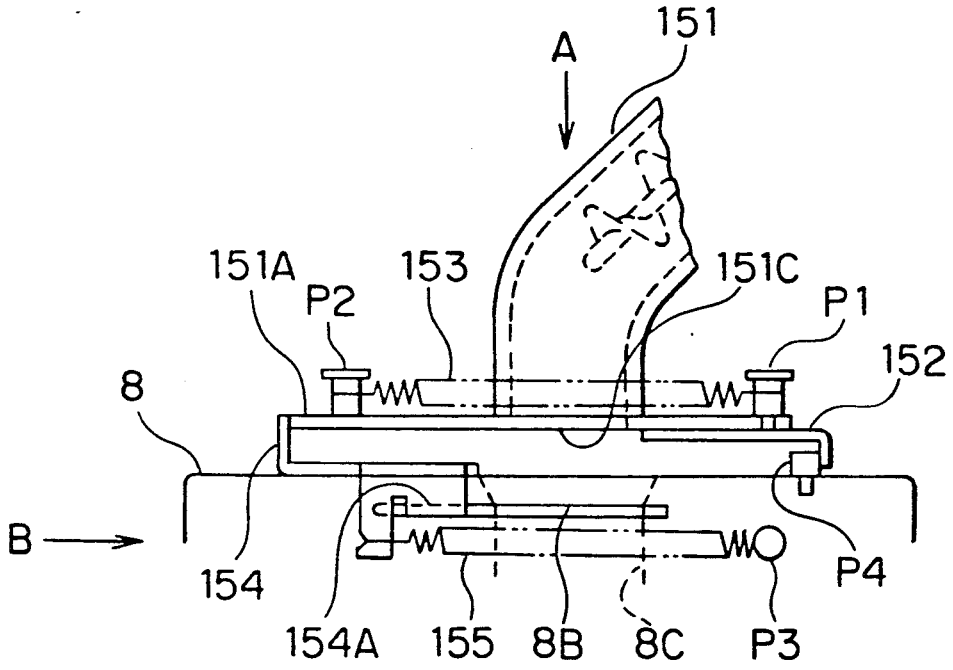
FIG. 11(A) is a side view of the main portion of the above-described apparatus.
Figure 11B:
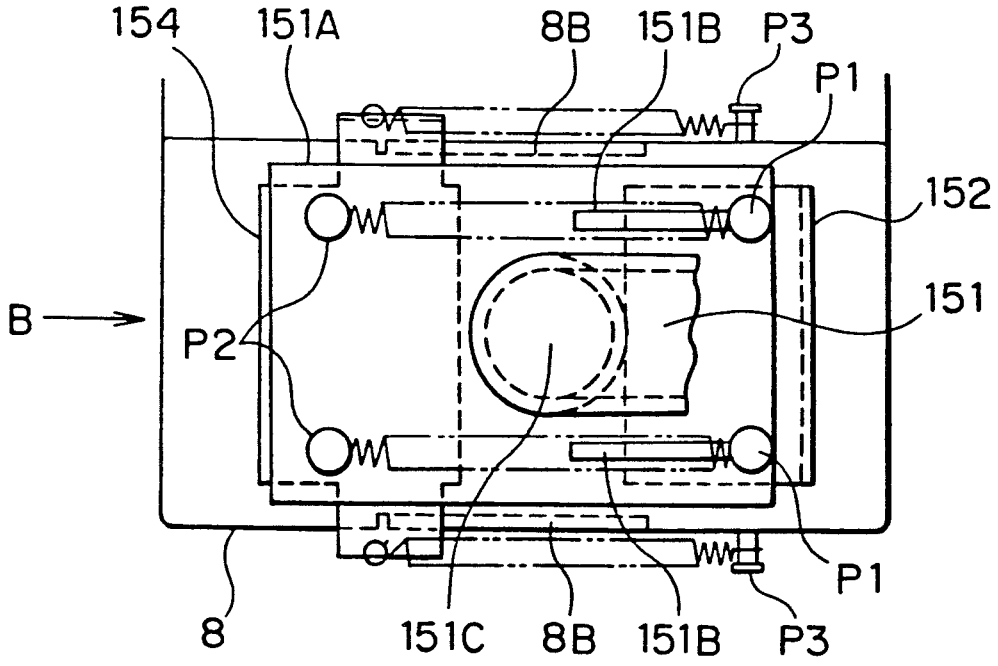
FIG. 11(B) is a plan view of the main portion of the above-described apparatus.

The connecting portion 155*b* of the used toner cartridge 155 and the collecting toner pipe 155*a* can be composed in the same structure as the engagement mechanism which engages the toner conveyance pipe to supply toner with the developing unit, which mechanism is illustrated in FIGS. 11(A) and 11(B).

In FIG. 11A and 11B there is shown an example of the engaging mechanism of the above-described toner conveyance pipe 151 and the developing means, wherein the engagement is conducted when the cartridge 30 is inserted into the apparatus. In this case, the developing means 8 is taken as an example. FIG. 11(A) is a side view and FIG. 11(B) is a plan view taken in the direction of arrow mark A in FIG. 11(A).

The rectangular flange plate 151A is integrally provided to the lower edge of the toner conveyance pipe 151. A pair of slotted holes 151B are provided to the flange plate 151A. The shutter plate 152 is provided with guide pin P1 which engages with the above-described slotted holes 151B, wherein the shutter plate 152 is slidably supported by the lower surface of the above-described flange plate 151A.

When the cartridge is not attached to the apparatus, the above-described shutter plate 152 is slid in the left direction by a pair of tension springs 153 stretched between the guide pin P1 and pin P2 provided on the flange plate 151A so that the toner dropping hole 151C of the toner conveyance pipe 151 can be sealed in order to prevent the toner from dropping.

The shutter plate 154 provided with a pair of claws 154A which engages with the guide grooves 8B provided to both sides of the toner receiving portion, is slidably supported on the upper surface of the developing means 8. When the cartridge 30 is not attached, the shutter plate 154 is slid in the right direction by the tension spring 155 which is stretched between the above-described claw 154A and pin P3 provided on the toner receiving portion so that the toner receiving hole 8C of the toner receiving portion can be sealed by the shutter plate 154 in order to prevent the toner from scattering and leaking out When the cartridge 30 is inserted into the apparatus main body, the developing means 8 is moved in the direction of arrow mark B in parallel with the cartridge. At this moment, the rising portion of the above-described shutter plate 154 comes into contact with the edge portion of the above-described flange plate 151A and then the pin P4 on the receiving portion comes into contact with the rising portion of the shutter plate 152. Accordingly, as illustrated in the drawing, both of the above-described toner dropping hole 151C and the toner receiving hole 8C are fully opened simultaneously with the installation of the cartridge 30. In the way described above, toner supply is completed.

When the cartridge 30 has been drawn out of the apparatus main body, the above-described shutter plates 152,154 are automatically returned to the initial positions and the toner dropping hole 151C and the toner receiving hole 8C are sealed again.

The engagement mechanism between each developing means and the toner conveyance pipe 151 is aligned vertically to the surface of FIG. 1(*a*) at each developing means. Consequently, when the cartridge 30 is attached to or detached from the apparatus, the developing means never interfere with each other so that engagement action can be conducted.

Figure 12:
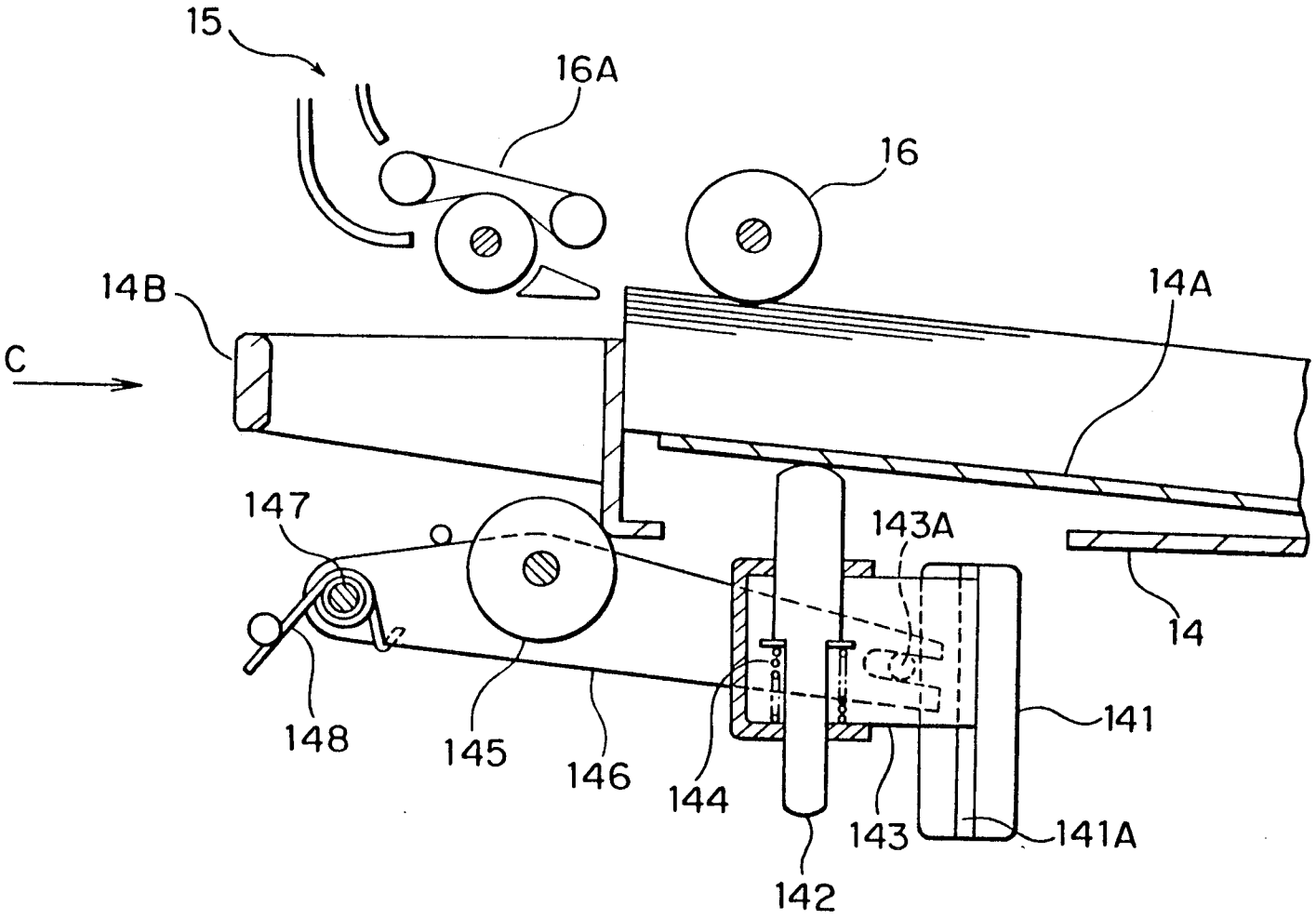
FIG. 12 is a side view of the main portion of the above-described apparatus.

FIG. 12 illustrates the transfer paper storage means by which the above-described paper feeding cassette 14 is installed in the apparatus main body. The inner surface of the above-described cassette storage chamber 140 is provided with a pair of guide members 141 which is composed in such a manner that the longitudinal grooves 141A are opposed to each other. The bent portion of the lifting member 143 which holds the pushing member 142, is engaged with the above-described longitudinal grooves 141A so that the lifting member 143 can be slid upward and downward. A pair of pushing members are provided in the direction vertical to the surface of the drawing and each of them are pushed upward by the compression spring 144.

The above-described cassette storage chamber 140 is further provided with a pair of oscillating levers 146 to which the rotative roller 145 is pivotally provided, wherein the supporting shaft 147 is used as a fulcrum. The tip of the oscillating lever 146 holds the engagement pin 143A provided on the outer surface of the above-described lifting member 143.

When the paper feeding cassette 14 is provided to the apparatus, the above-described oscillating lever 146 is pushed counterclockwise by the torsion spring 148, so that the lifting member 143 is slid upward, as a result the above-described pushing member 142 comes into contact with the bottom plate 14A of the paper feeding cassette 14. Consequently, transfer papers stacked on the bottom plate 14A is pressed against the paper feeding roller 16 while the transfer papers are pushed by the above-described compression spring 144.

The above-described pushing member 142 is lifted upward in accordance with the decrease in the number of transfer papers so that the uppermost transfer paper can be always pressed against the paper feeding roller 16.

The above-described paper feeding cassette 14 is slid via the handle 14B in the direction of arrow mark C horizontally to the above-described cassette storage chamber 140. When the paper feeding cassette 14 is inserted into the apparatus, the bottom surface of the cassette 14 pushes the above-described rotative roller 145 downward so that the oscillating lever 146 is rotated clockwise.

As a result, the lifting member 143 is slid downward. Then, the above-described pushing member 142 is pushed downward, and the upper end of the pushing member 142 is withdrawn so that it can not interfere with the bottom surface of the cassette 14. In this way the paper feeding cassette can be horizontally inserted into the apparatus.

The above described transfer paper storage means may be added to the above-described cassette storage chamber 140 in order to simultaneously provide a plurality of paper feeding cassettes of different paper sizes.

Furthermore, as illustrated in FIG. 1(*a*), the apparatus main body is composed in the structure of clamshell, which can be divided into the upper and lower halves. The upper body provided with the above-described toner hopper 150 can be opened clockwise with regard to the lower body provided with the above-described cartridge 30, the laser writing unit 7 and further the cassette chamber 140, wherein the hinge 160 is used as a fulcrum.

Figure 13:
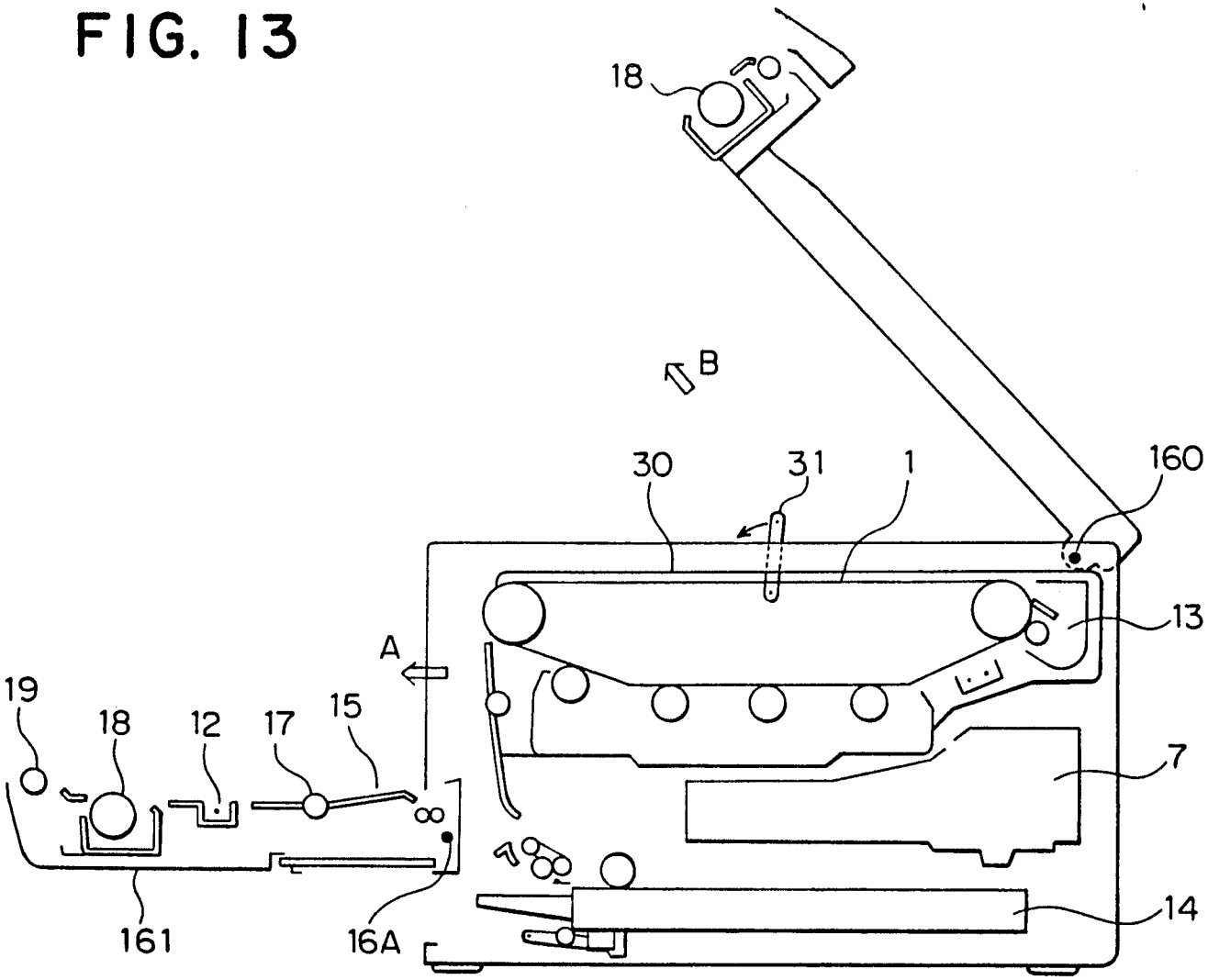
FIG. 13 and FIG. 14 are schematic illustrations which explain the composition of the apparatus main body.

FIG. 13 illustrates the first example in which the upper body can be opened and further the left side of the lower body is composed of the side cover 161 which can be opened and closed, wherein the shaft 161A is used as a fulcrum. When the cover 161 is opened as illustrated in FIG. 13, all of the transfer paper conveyance passage composed of the paper feed passage 15 to the paper delivery roller 19, are opened and the cartridge 30 can be easily attached to and detached from the lower main body in such a manner that: the cartridge 30 can be handled by the collapsible handle 31 in the direction of arrow mark A or arrow mark B so that the cartridge 30 can be smoothly slid in the left direction.

Figure 14:
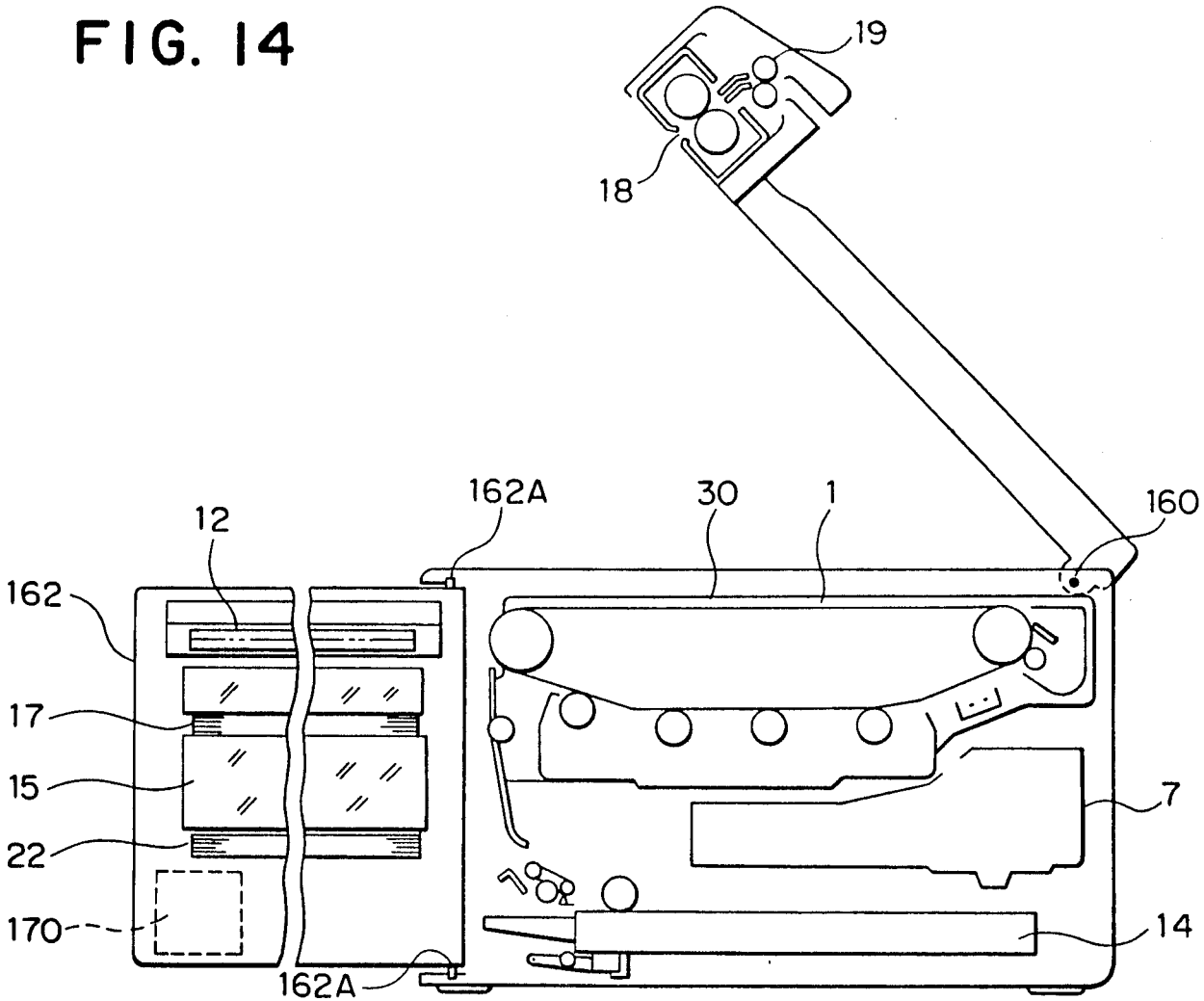

FIG. 14 shows the second example in which the left side of the lower main body is provided with the side cover 162 which can be horizontally opened and closed, wherein the shaft 162A is used as a fulcrum. The side cover 162 is provided with the transfer unit 12, the sheet by-pass guide plate 21, the sheet by-pass guide roller 22, the pair to the paper feed passage 15 and the pair to the timing roller 17.

When the above-described side cover 162 is opened, the cartridge 30 and the paper feed cassette 14 are slid from the left side so that it can be horizontally attached to the apparatus.

As illustrated in FIG. 14, the toner recovery tank 170 which recovers the waste toner sent from the cleaning unit 13, is provided to the left edge or the right edge (not illustrated in the drawing) of the side cover 161 so as to form a waste toner recovery unit, wherein the toner recovery tank is detachable.

The engagement of the toner recovery tank 170 and the toner recovery pipe (not illustrated in the drawing) can be achieved by the engagement mechanism which is applied to the engagement of the toner conveyance pipe 151 and each developing unit, wherein the engagement mechanism is illustrated in Figs. 11(A),11(B).

As illustrated in FIG. 11 and FIG. 14, it is also possible to provide the conveyance guide (d) 101*b* integrally to the detachable cartridge 30.

As illustrated in FIG. 1(*a*) a recording paper to be used for transfer is supplied from the recording paper storing cassette 14 (which will be called a cassette hereafter) which is installed in the cassette chamber 140.

As illustrated by a chained line in the drawing, the recording paper which has been conveyed out of the cassette 14 passes through the paper feed passage 15 composed of the conveyance guide (*a*) 100*a* , the conveyance guide (*b*) 100*b* and the cartridge side plate 310 so that the recording paper can be guided to the transfer unit.

When the above-described cassette 14 is horizontally pushed in the right direction by pushing the fixed handle 150 which is fixed on the left side surface of the cassette 14, the cassette 14 is engaged with the inside of the cassette chamber 140. When the cassette 14 is horizontally pulled out in the left direction by pulling the above-described handle 150 and the movable handle 150A provided on the bottom face of the cassette, the engagement can be released and the cassette 14 can be detached from the apparatus.

Figure 15:
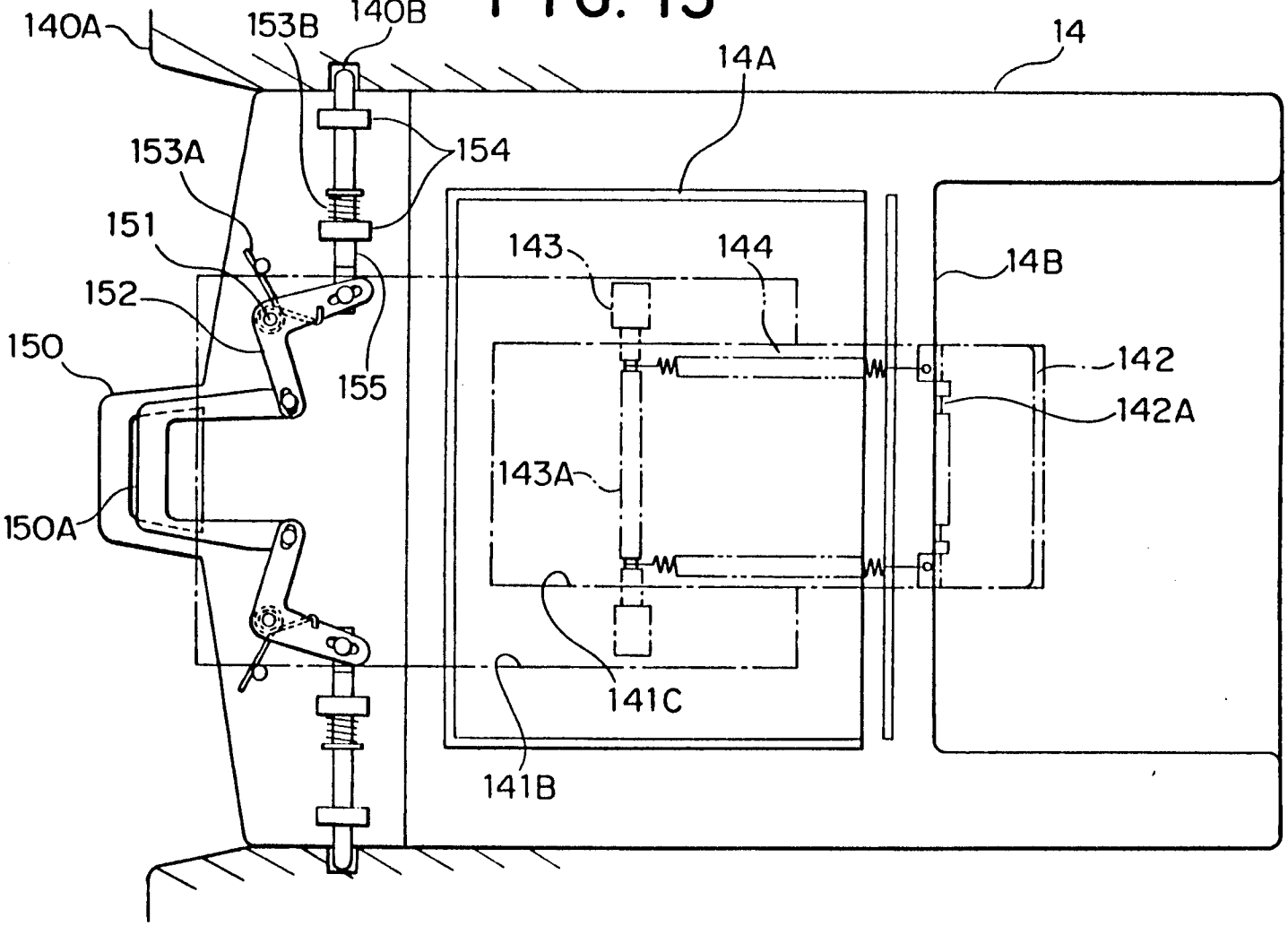
FIG. 15 is a plan view of the main portion of the image forming apparatus of the present invention.

FIG. 15 is a plan view of the above-described cassette 14 taken from the bottom side. A pair of bell cranks 152 are symmetrically provided to the bottom surface of the above-described handle 150, which bell crank can be rotated around the supporting shaft 151. One of the arms of the bell crank 152 is connected with the above-described handle 150A, and the other arm is connected with the lock pin 155 which is slidably supported by the protrusion 154 for guide use.

The tip of the lock pin 155 is protruded from the side of the cassette 14 by the action of the return spring 153A and the compression spring 153B and at the same time the above-described handle 150A is positioned a little apart from the handle 150.

When the cassette 14 is attached to the apparatus, the above-described lock pin 155 comes into contact with the side guide plate 140A in the cassette chamber 140, and the tip of the lock pin 155 is withdrawn from the side surface of the cassette. When the cassette has reached its setting position, the pin 155 is engaged with the lock hole 140B provided to the above-described side guide plate 140A.

When the cassette 14 is taken out of the apparatus, the above-described handle 150A is held integrally with the handle 150 so that they can be united. Then, the engagement of the above-described lock pin 155 and the lock hole 140B is released and the cassette 14 can be pulled out in the direction of the handle.

The recording paper held in the cassette 14 which is located at a predetermined position in the cassette chamber 140, comes into contact with the paper feed roller 16. In this way the apparatus is prepared for feeding a recording paper.

The bottom guide plate 141 of the above-described cassette chamber 140 is provided with the cut-out portion 141A, the ramp 141B and the guide portion 141C. The width of the above-described cut-out portion 141A and that of the ramp 141B next to the cut-out portion are a little narrower than the bottom plate 14A on which the recording papers in the cassette 14 are stacked. On the other hand, the width of the guide 141C is further narrower than that.

The above-described guide 141C is provided with the slide plate 142 having the rising portion 142A which comes into contact with the step portion 14B of the cassette 14 bottom.

A pair of rotatable pushing roller 143 which are united by the connecting shaft 143A, are located on the above-described ramp 141B, and the bottom plate 14A in the cassette 14 is pushed up by the force of the tension spring 144 which is stretched between the above-described connecting shaft 143A and the above-described slide plate 142, so that the recording papers stacked on the bottom plate 14A can come into contact with the above described paper feed roller 16. Accordingly, when the number of the recording papers on the bottom plate 14A is decreased, the above-described pushing roller 143 is automatically moved on the ramp 141B in the right direction, and the above-described bottom plate 14A is further pushed up so that the paper feed roller can keep contacting with the recording paper with pressure.

The paper feeding condition of the cassette 14 can be automatically release by returning the slide plate 142 and the pushing roller 143 to the initial positions.

When the cassette 14 is horizontally moved in the left direction, the above-described pushing roller 143 is moved on the ramp 141B in the left direction, and at the same moment the above-described slide plate 142 which has been released from the pressure contact with the step portion 14B, is moved in the left direction by the force of the tension spring 144.

Finally the above-described pushing roller 143 engages with the cut-out portion 141A on the bottom guide plate 141, and then the above-described slide plate 142 comes into contact with the left edge portion of the guide 141C and stops. Therefore the cassette 14 can be taken out of the cassette chamber 14 without any difficulty.

When the cassette 14 is inserted into the cassette chamber 140, the step portion 14B of the cassette 14 comes into contact with the above-described slide plate 142 and the slide plate 142 is moved in the right direction so that the above-described tension spring 144 can be stretched.

When the bottom plate 14A of the cassette 14 reaches the top of the above-described pushing roller 143 in the cut-out portion 141A, the pushing roller 143 is released from the restriction by the bottom plate of the cassette 14 and the pushing roller runs on the ramp 141B and pushes up the bottom plate 14A so that the recording papers can be fed.

A recording paper of special size taken out of and supplied from the above-described cassette 14 is sent out to the paper feed passage 15 one sheet by one sheet. The recording paper passes through the timing roller 17 and advances to the transfer unit 12 synchronously with image forming on the photoreceptor belt 1.

The above-described photoreceptor belt 1 and the developing units including the charger 6, the cleaning unit 13, the pair to the paper feed passage 15 and the pair to the timing roller 17, are integrally provided to the cartridge 30, so that they can be attached to and detached from the apparatus main body all at once.

When the above-described cartridge 30 is provided to the apparatus main body, each developing means is automatically connected with the toner conveyance pipe 151 of the toner hopper 150 reciprocal to each developing means so that toner can be supplied to each developing means.

The above-described apparatus is provided with a sheet by pass as well as the above-described automatic paper feeding means by the cassette 14. When a recording paper is supplied according to the method of sheet by-pass, the sheet by-pass guide plate 21 provided on the side of the apparatus main body, is horizontally opened, and the inserted recording paper is conveyed one sheet by one sheet to the above-described paper feed passage 15 through the sheet by pass guide roller 22.

Further, the apparatus main body has the structure of a clam-shell, so that it can be divided into an upper half and a lower half. Accordingly, the upper body to which the above-described toner hopper 150 is provided, can be opened clockwise with regard to the lower body to which the above-described cartridge 30, the laser writing unit 7 and the cassette chamber 140 are provided, wherein the hinge 160 illustrated in FIG. 1(*a*) is used as a fulcrum, and the opened upper body can be held at the position.

Figure 16:
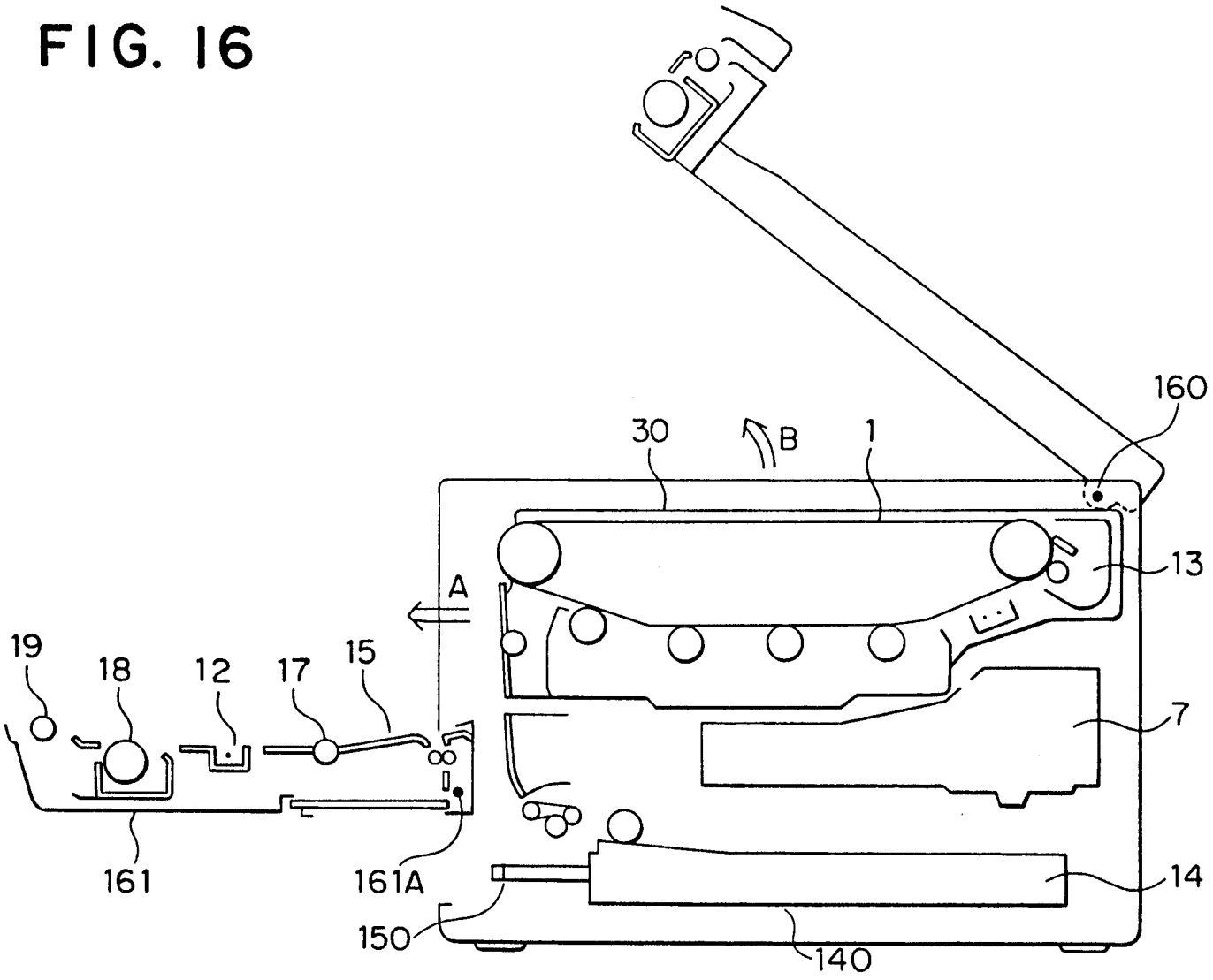
FIG. 16 and FIG. 17 are schematic illustrations which show the composition of the main body of the above-described apparatus.

FIG. 16 shows an example of the first composition which is composed in such a manner that: the upper body can be opened; and further the left side of the lower body is composed of a side cover 101 which can be vertically opened and closed, wherein the shaft 161A is used as a fulcrum. In this example, when the side cover 161 is opened as illustrated in the drawing, all of the transfer paper conveyance passage located between the paper feeding passage and the delivery roller 19 can be opened, and when the cartridge 30 is attached to and detached from the lower body, the cartridge 30 is horizontally slid in the direction of arrow mark A or B without any difficulty.

Figure 17:
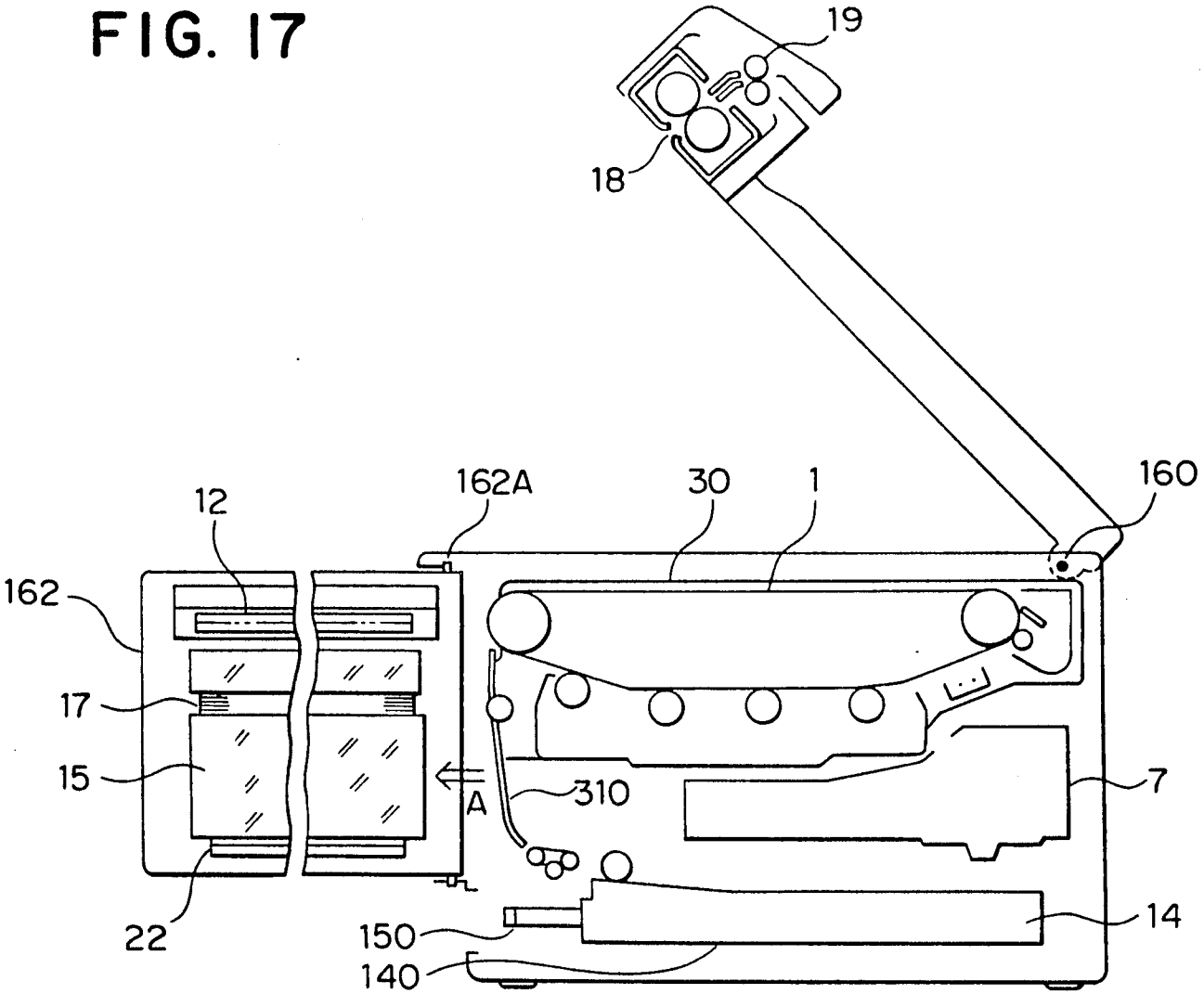

FIG. 17 shows an example of the second composition. In this example the left side of the lower body is composed of the side cover 162 which can be horizontally opened and closed, wherein the shaft 162A is used as a fulcrum. The side cover 162 is provided with the transfer unit 12, the sheet by-pass guide plate 21, the sheet by-pass guide roller 22, the pair to the paper feed passage 15 and the pair to the timing roller 17

When the side cover 162 is opened, the cartridge 30 and the paper cassette 14 can be horizontally slid and detached from the lower body in the left direction with regard to the lower main body. It is possible to extend the cartridge side plate 310 as illustrated in the drawing so that it can form the paper feed passage 15.

The effect of the invention is as follows. First, the color image forming apparatus of the present invention is composed in such a manner that one side of the apparatus can be opened, so that the following effect can be achieved by the apparatus of the invention. The problems caused in the paper feed and conveyance unit such a paper jam can be easily solved: image forming means such as the belt-shaped image forming body and a plurality of developing means can be simply and safely attached to and detached from the apparatus main body: and further the structure of the apparatus is very simple.

Second, the apparatus of the present invention is composed in such a manner that: one side of the apparatus main body is opened so that the all the transfer paper passage can be opened; and the process cartridge to which the photoreceptor and a plurality of developing means are provided, and the paper feeding cassette can be attached to and detached from the apparatus through the opening. Therefore, copying operation, paper feeding operation including sheet by-pass and various maintenance work can be conducted on one side of the apparatus. As a result, a practical color image forming apparatus can be provided that: operation and maintenance work can be easily conducted; and a wide space is not necessary to install the apparatus.

Third, a handle is provided to the apparatus of the present invention. Accordingly, the recording paper cassette can be easily inserted into an inner part of the apparatus so that it can be set at a predetermined position: and the above-described cassette can be set to and released from the paper feeding condition by the motion of simple members when the cassette is attached to and detached from the apparatus. As a result, a compact image forming apparatus, the structure of which is simple and the cassette of which is not protruded from the apparatus, can be provided.

What is claimed is:

1. A color image forming apparatus for transferring a color image onto a transfer material, comprising:

a housing having, an interior, at least one side, and an opening formed in said one side to provide access to said interior of said housing;

a movable cover mounted to cover said opening in said housing, said cover having an exterior surface and an interior surface;

guide means mounted on said interior surface of said cover to face said interior of said housing;

first transfer material holding means for holding said transfer material, onto which said color image is to be transferred;

conveyor means positioned in said housing for conveying said transfer material from said first transfers material holding means;

a process cartridge detachably mounted in said housing, said process cartridge, comprising:

means for detachably mounting said cartridge to said housing;

a sidewall;

an elongated image forming body having first and second end portions;

first and second roller means respectively positioned at said first and second end portions of said image forming body; and a photoreceptor endless belt stretched around said image forming body and said first and second roller means; and a transfer material conveying passage for conveying said transfer material from said first transfer material holding means therethrough, said transfer material conveying passage being at least partially defined by said sidewall of said process cartridge and by said guide means mounted on said interior surface of said cover;

said process cartridge being accessible for removal from said housing through said opening in said housing by moving said cover to expose said sidewall of said cartridge; whereby movement of said cover not only provides direct access to said transfer material conveying passage to facilitate quick and easy clearance of any transfer material james in said passage without the need to move said process cartridge but also provides direct access to said process cartridge; and a plurality of developing means formed integrally with said process cartridge positioned in said housing below said process cartridge;

releasable holding means for releasably holding said process cartridge and said developed means in place in said housing; and said process cartridge being releasable from said housing after release of said releasable holding means.

2. The apparatus according to claim 1, further comprising a fixing unit mounted in said housing for fixing said color image to said transfer material, said fixing unit being positioned in said housing such that movement of said cover exposes said fixing unit.

3. The apparatus according to claim 1, further comprising:

a plurality of toner hoppers positioned above said process cartridge in said housing;

each of said toner hoppers having a toner conveyance duct attached thereto; and said process cartridge, upon being positioned in said housing, positioning each of said toner conveyance ducts to feed toner to a different one of said developing means.

4. The apparatus according to claim 1, wherein said first transfer material holding means is positioned within said housing below said plurality of developing means.

5. A color image forming apparatus for transferring a color image onto a transfer material, comprising:

a housing having, an interior, at least one side, and an opening formed in said one side to provide access to said interior of said housing;

a movable cover mounted to cover said opening in said housing, said cover having an exterior surface and an interior surface;

guide means mounted on said interior surface of said cover to face said interior of said housing;

first transfer material holding means for holding said transfer material, onto which said color image is to be transferred;

conveyor means positioned in said housing for conveying said transfer material from said first transfer material holding means;

a process cartridge detachably mounted in said housing, said process cartridge, comprising:

means for detachably mounting said cartridge to said housing;

a sidewall;

an elongated image forming body having first and second end portions;

first and second roller means respectively positioned at said first and second end portions of said image forming body; and a photoreceptor endless belt stretched around said image forming body and said first and second roller means; and a transfer material conveying passage for conveying said transfer material from said first transfer material holding means therethrough, said transfer material conveying passage being at least partially defined by said sidewall of said process cartridge and by said guide means mounted on said interior surface of said cover;

said process cartridge being accessible for removal from said housing through said opening in said housing by moving said cover to expose said sidewall of said cartridge; whereby movement of said cover not only provides direct access to said transfer material conveying passage to facilitate quick and easy clearance of any transfer material jams in said passage without the need to move said process cartridge but also provides direct access to said process cartridge.

a plurality of developing means formed integrally with said process cartridge positioned in said housing below said process cartridge;

releasable holding means for releasably holding said process cartridge and said developing means in place in said housing; and said process cartridge being releasable from said housing after release of said releasable holding means;

second transfer material holding means;

transfer material bypass means for feeding transfer material from said second transfer material holding means; and holding means detachably attachable to said cover for holding said second transfer material holding means;

said transfer material bypass means operating to bypass said first transfer material holding means, and to feed said transfer material from said second transfer material holding means to said transfer material conveying passage.

6. The apparatus according to claim 5, wherein said housing comprises:

an upper half; and a lower half;

said lower half including: said process cartridge; said transfer material conveying passage; said transfer material bypass means; said first transfer material holding means; and means for opening said upper half of said housing.

7. The apparatus according to claim 5, further comprising:

gripping means on said transfer material holding means to facilitate removal of said first transfer material holding means from said housing through said opening.

8. A color image forming apparatus for forming a color image, comprising:

conveyance passage means for conveying a transfer material in an upward direction, wherein said upwardly directed conveyance passage means is arranged so as to be exposed by opening one side face of the image forming apparatus;

a process cartridge comprising a belt-shaped image forming body which is stretched between rollers disposed in a horizontal direction, wherein the process cartridge is detachably mountable in a horizontal direction onto the same side face of the image forming apparatus as said one side face when said one side face of the image forming apparatus is opened;

a plurality of developing means disposed in parallel with the belt-shaped image forming body; and a transfer material holding means disposed below the belt-shaped image forming body, for feeding the transfer material toward the conveyance passage.

9. A color image forming apparatus for forming a color image, comprising:

a process cartridge comprising an interchangeable belt-shaped image forming body and a plurality of developing means disposed in parallel with and around the belt-shaped image forming body, both being integrally united;

a manual sheet by-pass means for feeding a transfer sheet;

sheet holding and feeding means detachable attachable onto the image forming apparatus, for holding and feeding the transfer sheet; and a transfer sheet conveyance passage having a side face capable of being opened, and through which the transfer sheet is conveyed, wherein a replacement operation of the process cartridge, a sheet feeding operation at the manual sheet by-pass means and a detaching and attaching operation of the transfer sheet holding and feeding means are conducted in the same direction as said side face which is capable of being opened, when said side face is opened.

* * * * *